US005664999A

United States Patent [19]

Kurihara

[11] Patent Number: 5,664,999

[45] Date of Patent: Sep. 9, 1997

[54] PICTURE AMUSEMENT APPARATUS

[75] Inventor: Satoru Kurihara, Tokyo, Japan

[73] Assignee: Sammy Industries, Co., Ltd., Tokyo, Japan

[21] Appl. No.: 526,053

[22] Filed: Sep. 8, 1995

[30] Foreign Application Priority Data

Jun. 23, 1995 [JP] Japan ..... 7-157265

[51] Int. Cl.[6] ..... G07F 17/34

[52] U.S. Cl. ..... 463/20; 463/25; 273/143 R

[58] Field of Search ..... 273/143 R, 138.2; 463/19, 20, 12, 13, 25

[56] References Cited

U.S. PATENT DOCUMENTS 5,393,061 2/1995 Manship et al. ..... 463/20

FOREIGN PATENT DOCUMENTS 1242298 8/1971 United Kingdom ..... 273/143 R 2222712 3/1990 United Kingdom ..... 273/143 R

WO86/05407 9/1986 WIPO .

*Primary Examiner*—Benjamin H. Layno

*Attorney, Agent, or Firm*—Wolf, Greenfield & Sacks, P.C.

[57] ABSTRACT

The present invention provides a highly entertaining picture amusement apparatus which keeps a player free from boredom even for a long time playing session and which makes the player find the game playing more enjoyable and expect more from the game, by running a sub-game different from the main game on the profit or score the main game makes and by increasing or decreasing the profit according to the score of the sub-game. The present invention comprises sub-game control means for running the sub-game on condition that the shifting to the sub-game is selected by sub-game shift selection means and also on condition that a profit (game medals, for example) is given by main game determination means, and increase/decrease means for increasing or decreasing the profit scored by the player in the main game, according to the result of the sub-game that is run by the sub-game control means.

4 Claims, 24 Drawing Sheets

PICTURE AMUSEMENT APPARATUS

BACKGROUND OF THE INVENTION

1. Field of the Invention

The present invention relates to a picture amusement apparatus, and in particular to the picture amusement apparatus that allows a sub-game, different from the main game, to run to increase or decrease the profit or score the main game makes.

2. Description of the Related Art

One known type of picture amusement apparatus is a game slot machine which comprises a plurality of CRT monitor devices arranged in a matrix, game control means that allows a slot machine game to proceed according to a predetermined program, CRT control means for controlling a plurality of CRT control devices according to the instruction from the game control means so that the plurality of CRT monitor devices present in harmony the game session that is in progress by means of the game control means, and medal payout means for paying out game medals or tokens according to the instruction of the game control means based on the result of the game session (International Laid Open No. W088/05407 (Japanese Patent Application No. Sho-60-501228)).

In the above known slot machine, a "win" or a "lose" of one game play session is determined by,the matching of symbols that stop on the pay line selected.

When a player wins, the picture amusement apparatus pays off medals, the number of which is determined by a predetermined payoff rate, the number of medals entered, kinds of pay lines, and kinds of symbols.

In the above picture amusement apparatus, however, a game player can enjoy only a slot machine game, in which a win or lose is determined depending on the matching of symbols stopped on the pay line selected, and the number of game medals paid off per play is predetermined. The game playing itself thus becomes monotonous. If a player plays it for a long time, he gets boring and finds playing less interesting.

SUMMARY OF THE INVENTION

It is a chief object of the present invention to provide a highly entertaining picture amusement apparatus which keeps a player free from boredom even for a long time playing session and which makes the player find the game playing more enjoyable and expect more from the game, by running a sub-game different from the main game on the profit or score the main game has made and by increasing or decreasing the profit according to the score of the sub-game.

It is another object of the present invention to provide a highly entertaining picture amusement apparatus which meets a diversity of players' taste, by allowing each player to determine whether to play the main game only or the main game plus sub-game with a possibility of increasing or decreasing the profit the main game has made.

It is yet another object of the present invention to provide a picture amusement apparatus which, in the playing of the sub-game different from the main game, makes each player feels the score of the sub-game fair, by allowing each player to participate in the decision process of a basic number that works as a reference for determining the score of the sub-game.

It is yet another object of the present invention to provide a picture amusement apparatus which, in the playing of the sub-game different from the main game, makes each player feels the score of the sub-game fair, by allowing each player to participate in the decision process of the determination method of the score of the sub-game.

It is yet another object of the present invention to provide a picture amusement apparatus which, in the playing of the sub-game different from the main game, offers a thrilling game playing by correlating the increase or decrease of the profit obtained in the main game with the type of symbols stopped and presented.

It is yet another object of the present invention to provide a picture amusement apparatus which offers a thrilling game playing by relating the increase or decrease of the profit obtained in the main game to the type of a target symbol that is hit on a display screen in response to the player's external maneuvering.

To achieve the above objects, the present invention comprises the following elements in each of the claims.

According to claim 1, the present invention comprises, as a first element, main game start enable means that allows a slot machine game to be ready to start as shown in FIG. 2 on condition that a medal is entered.

A second element is main game control means that allows the main game to run conditional on the entry of a start signal in the slot machine game that is set to be ready to start by the main game start enable means.

A third element is main game determination means that determines the result of the slot machine game run by the main game control means, for example, as shown in FIG. 2.

A fourth element is sub-game shift selection means that allows the player to have the option to shift to a sub-game as shown in FIG. 8 on condition that a profit (in the form of a medal, for example) is given in the main game by the main game determination means.

A fifth element is sub-game control means that allows the sub-game to run on condition that the shifting to the sub-game is selected by the sub-game shift selection means as shown in FIG. 9.

A sixth element is profit increase/decrease means that increases or decreases the profit (in the form of a medal, for example) scored by the player in the main game, according to the result of the sub-game that is run by the sub-game control means.

According to claim 2, the present invention comprises sub-game continued running selection means which, as shown in FIG. 8, gives the player the option to continue the sub-game in response to the player's external maneuvering on condition that the profit scored by the player has been increased by the profit increase/decrease means.

According to claim 3, the present invention comprises the following elements.

A first element of claim 3 of the present invention is sub-game control means which, as shown in FIG. 9, comprises a basic numeral screen partition (50) for scrolling numerals fast within a predetermined range on a display screen (11), select numeral indicator partitions (40 through 42) distinct from the basic numeral screen partition (50) for scrolling numerals fast within a predetermined range, basic numeral scroll stop means for allowing the player to stop the scrolling of the numerals in the basic numeral screen partition (50) in response to the player's external maneuvering, and select numeral scroll stop means for allowing the player to stop the scrolling of the numerals in the select numeral indicator partitions (40 through 42) in response to the player's external maneuvering.

A second element is the profit increase/decrease means which, as shown in FIG. 12, determines whether to increase or cancel out the profit already scored by the player by comparing a basic numeral stopped and presented in said basic numeral screen partition (50) with a select numeral stopped and presented in said select numeral indicator partitions (40 through 42).

According to claim 4, said sub-game control means comprises increase criteria selection means which, as shown in FIGS. 21 and 22, allows the player to select between the two criteria in response to the player's external maneuvering, one criterion that sets the increase of the profit on condition that the select numeral stopped and presented in the select numeral indicator partitions is greater than the basic numeral stopped and presented in the basic numeral screen partition and the other criterion that sets the increase of the profit on condition that the select numeral is smaller than the basic numeral by comparing the basic numeral stopped and presented in said basic numeral screen partition (50) with the select numeral stopped and presented in said select numeral indicator partitions (40 through 42).

According to claim 5, the present invention has the following elements.

A first element of claim 5 is the sub-game control means which, as shown in FIG. 23, comprises a symbol screen partition (170) for cycling through a plurality of symbols for display on the display screen (11), and symbol cycling stop means for allowing the player to stop the cycling of the symbols in the symbol screen partition (170) in response to the player's external maneuvering.

A second element of claim 5 is the profit increase/decrease means which, as shown in FIG. 23, determines whether to increase or cancel out the profit already scored by the player, depending on the type of the symbol stopped and presented in the symbol screen partition (170).

According to claim 6, the present invention comprises the following two elements.

A first element is the sub-game control means which, as shown in FIG. 25, comprises moving target screen partition (191) for displaying a plurality of types of moving target symbols on the display screen (11), and external controller means with which the player shoots a bullet at one of the plurality types of moving target symbols (190) presented in the moving target screen partition (191) on the display screen (11).

A second element is the profit increase/decrease means which determines whether to increase or cancel out the profit already scored by the player depending on the type of the target (190) the bullet has hit.

In claim 1 of the present invention, the main game start enable means sets a slot machine game to be ready to start when a game medal is inserted.

With the slot machine game ready to start, the main game control means runs the slot machine game upon entry of a start signal.

The main game determination means determines the result of the slot machine game.

The sub-game shift selection means allows the player to select whether to shift to a sub-game or not as shown in FIG. 8 when a profit is scored by the main game determination means.

When the shift to the sub-game is selected, the sub-game control means runs the sub-game as shown in FIGS. 8 through 17.

The profit increase/decrease means increases or decreases the profit scored by the player, namely won in the slot machine game, according to the result of the sub-game that is run by the sub-game control means, as shown in FIGS. 13 and 17.

In claim 2 of the present invention, when the profit increase/decrease means has increased the profit scored by the player, the sub-game continued running selection means allows the player to decide whether to continue the sub-game further by the player's external maneuvering.

In claim 3 of the present invention, the basic numeral screen partition (50) fast scrolls numerals within a predetermined range as shown in FIG. 9.

The basic numeral scroll stop means stops the scrolling of the numerals in the basic numeral screen partition (50) in response to the player's external maneuvering as shown in FIG. 10.

The select numeral indicator partitions (40 through 42) fast scroll numerals within a predetermined range as shown in FIG. 11.

The select numeral scroll stop means stop the scrolling of the numerals in the select numeral indicator partitions (40 through 42) in response to the player's external maneuvering as shown in FIGS. 12, 14 and 16.

The profit increase/decrease means determines whether to increase or cancel out the profit already scored by the player by comparing a basic numeral stopped and presented in said basic numeral screen partition (50) with select numerals stopped and presented in said select numeral indicator partitions (40 through 42).

In claim 4 of the present invention, the basic numeral screen partition (50) fast scrolls numerals within a predetermined range as shown in FIG. 9.

The basic numeral scroll stop means stops the scrolling of the numerals in the basic numeral screen partition (50) in response to the player's maneuvering as shown in FIG. 10.

The select numeral indicator partitions (40 through 42) fast scroll the numerals within the predetermined range as shown in FIG. 11.

The select numeral scroll stop means stop the scrolling of the numerals in the select numeral indicator partitions (40 through 42) in response to the player's external maneuvering as shown in FIGS. 12, 14 and 16.

The profit increase/decrease means compares the basic numeral stopped and presented in the basic numeral screen partition (50) with the select numerals stopped and presented in the select numeral indicator partitions (40 through The increase criteria selection means compares the basic numeral stopped and presented in said basic numeral screen partition (50) with the select numeral stopped and presented in said select numeral indicator partitions (40 through 42) and then allows the player to select between the two criteria in response to the player's external maneuvering, one that sets the increase of the profit on condition that the select numeral stopped and presented in the select numeral indicator partitions is greater than the basic numeral stopped and presented in the basic numeral screen partition and the other that sets the increase of the profit on condition that the select numeral is smaller than the basic numeral, as shown in FIG.

When the player selects the criteria in which the increase of the profit is on condition that the select numeral stopped and presented in the select numeral indicator partitions (40 through 42) is greater than the basic numeral stopped and presented in the basic numeral screen partition (50), and when the select numeral is actually greater than the basic numeral, the profit increase/decrease means increases the profit already scored by the player.

When the player selects the criteria in which the increase of the profit is on condition that the select numeral stopped and presented in the select numeral indicator partitions (40 through 42) is smaller than the basic numeral stopped and presented in the basic numeral screen partition (50), and when the select numerals are actually smaller than the basic numeral, the profit increase/decrease means increases the profit already scored by the player.

In claim 5 of the present invention, the symbol screen partition (170) cycles through a plurality of symbols for display as shown in FIG.

The symbol cycling stop means stops the cycling of the symbols in the symbol screen partition (170) in response to the player's external maneuvering.

The profit increase/decrease means determines whether to increase or cancel out the profit already scored by the player, depending on the type of the symbol stopped and presented in the symbol screen partition.

In claim 6 of the present invention, moving target screen partition (191) displays a plurality of types of moving target symbols (190) as shown in FIGS. 25 and 27.

With the external controller means, the player shoots a bullet at the plurality types of moving target symbols (190) presented in the moving target screen partition (191) on the display screen (11).

The profit increase/decrease means determines whether to increase or cancel out the profit already scored by the player depending on the type of the target (190) the bullet has hit on the display screen (11).

BRIEF DESCRIPTION OF THE DRAWINGS

FIG. 8 is an explanatory view showing a sub-game selection screen.

DETAILED DESCRIPTION OF THE PREFERRED EMBODIMENTS

FIGS. 1 through 19 show the first embodiment of the present invention.

Figure 1:
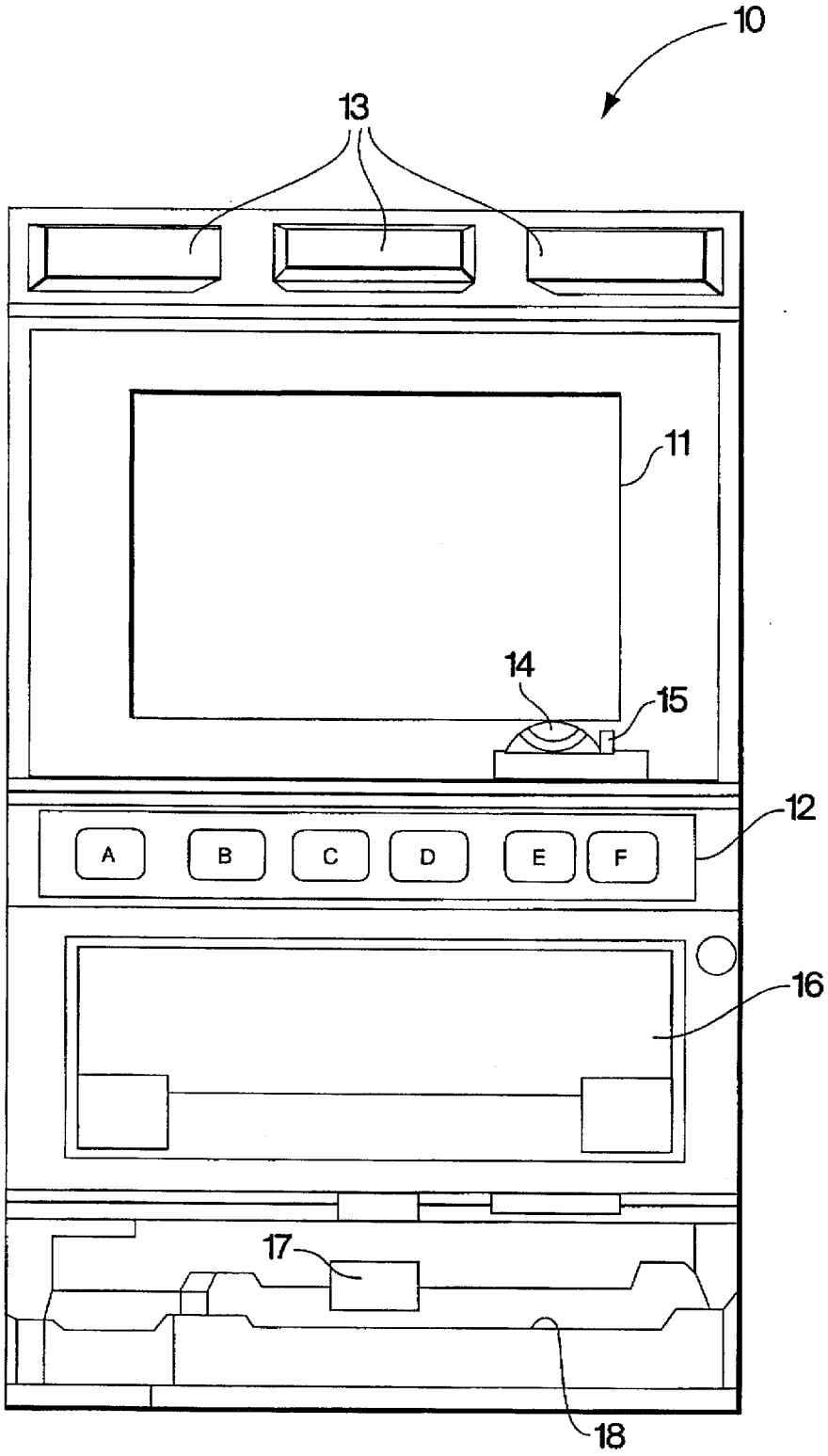
FIG. 1 is a diagrammatic front view showing the picture amusement apparatus according to a first embodiment of the present invention.
Figure 2:
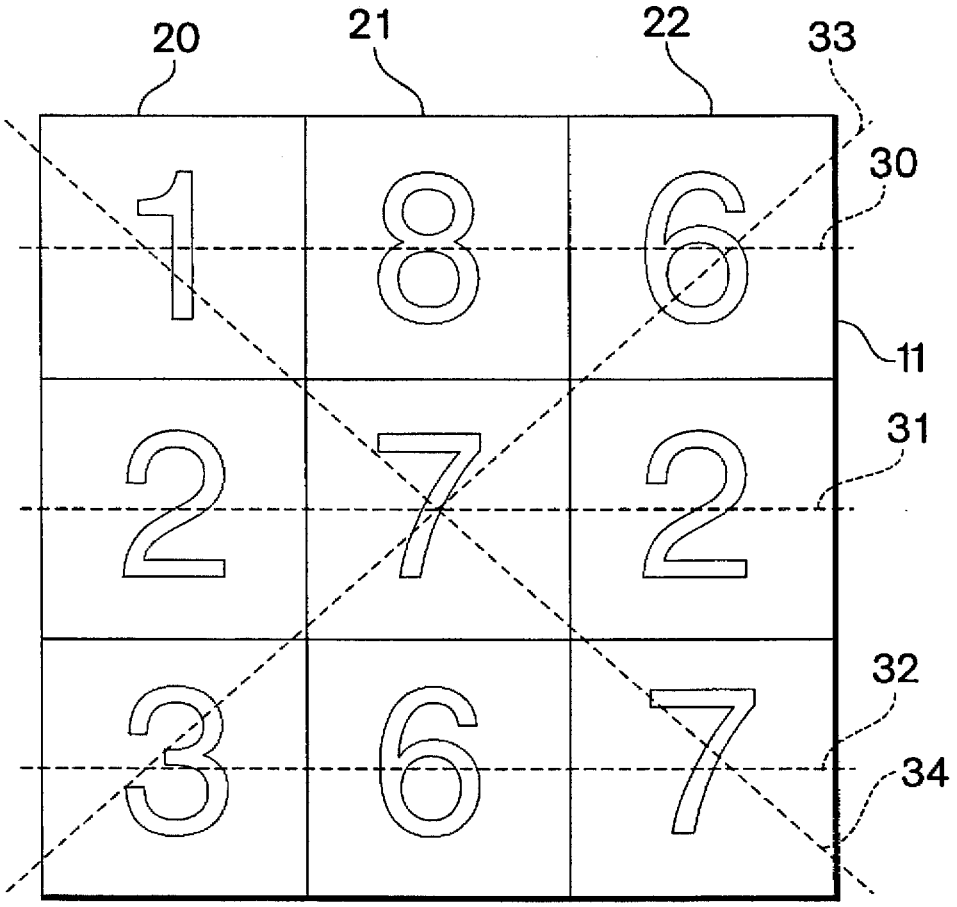
FIG. 2 is a front view of the display screen in its slot machine game session.
Figure 3:
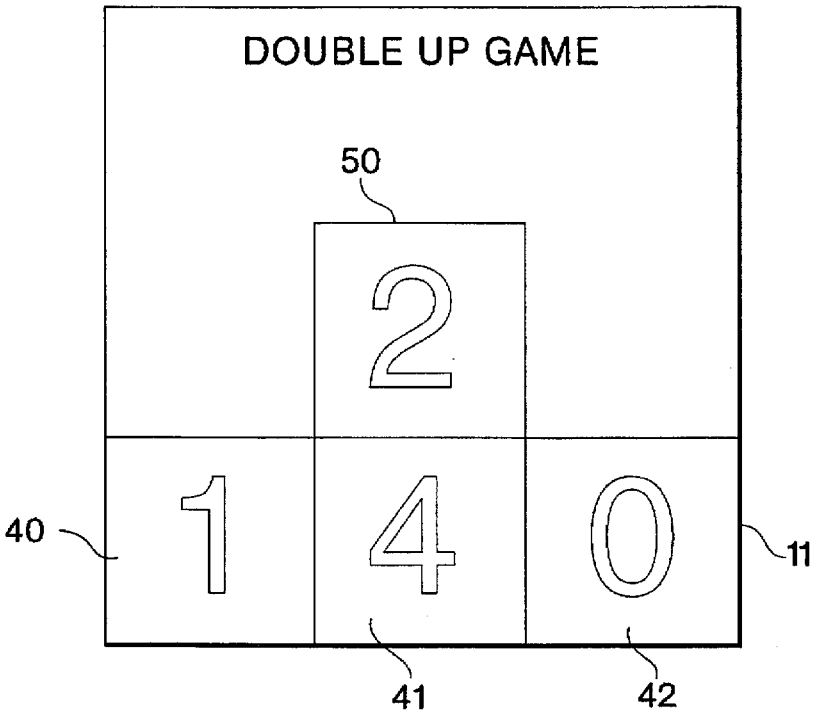
Figure 4:
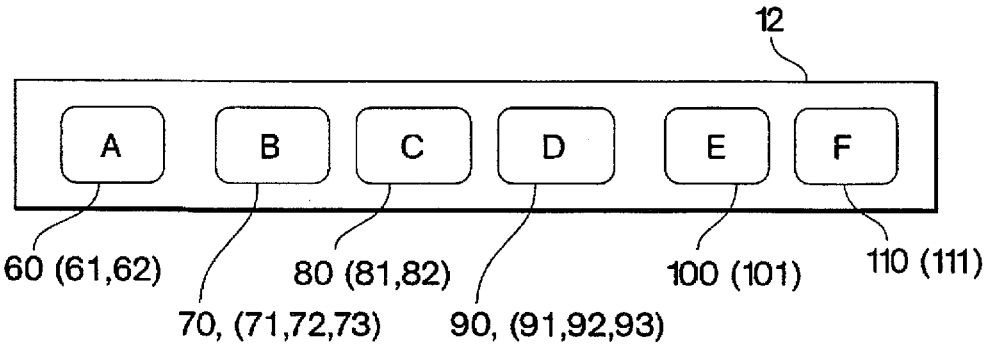
FIG. 4 is an enlarged front view of the operation panel of the apparatus.
Figure 5:
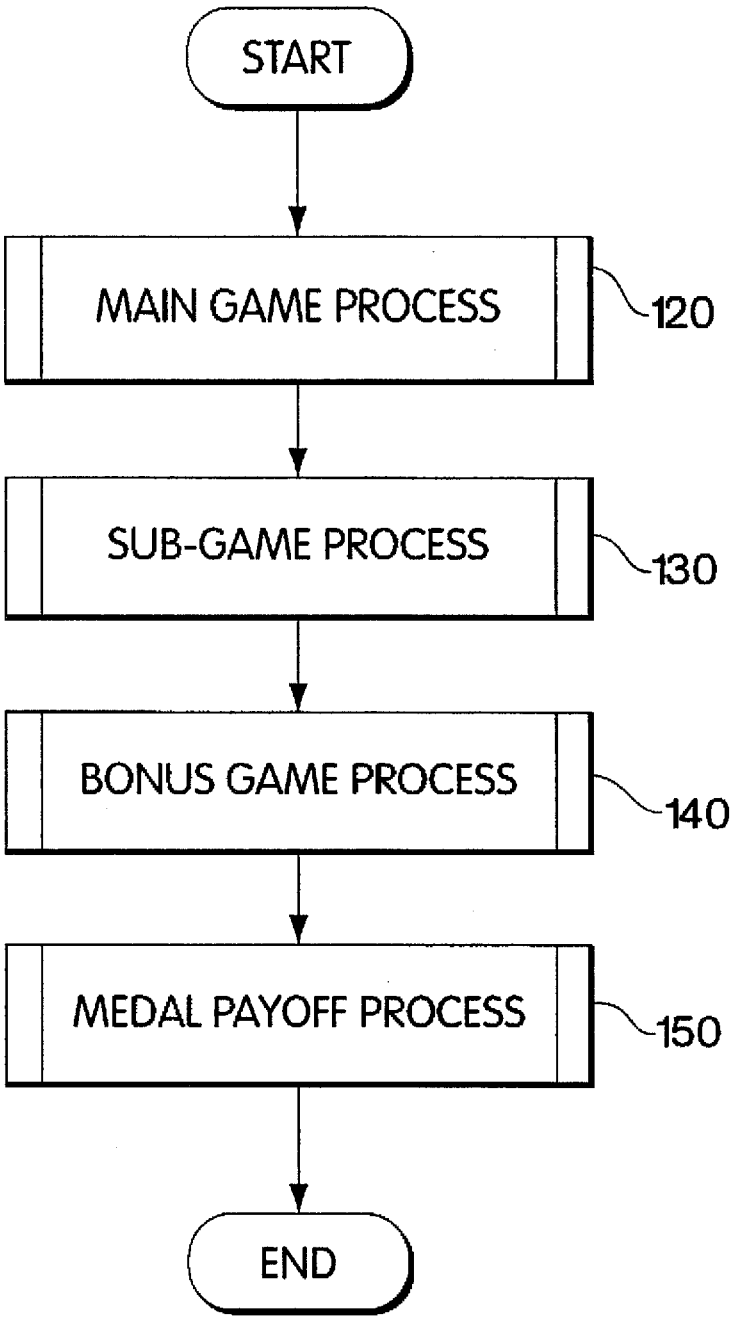
FIG. 5 is a flow diagram showing the rough operation of the picture amusement apparatus.
Figure 6:
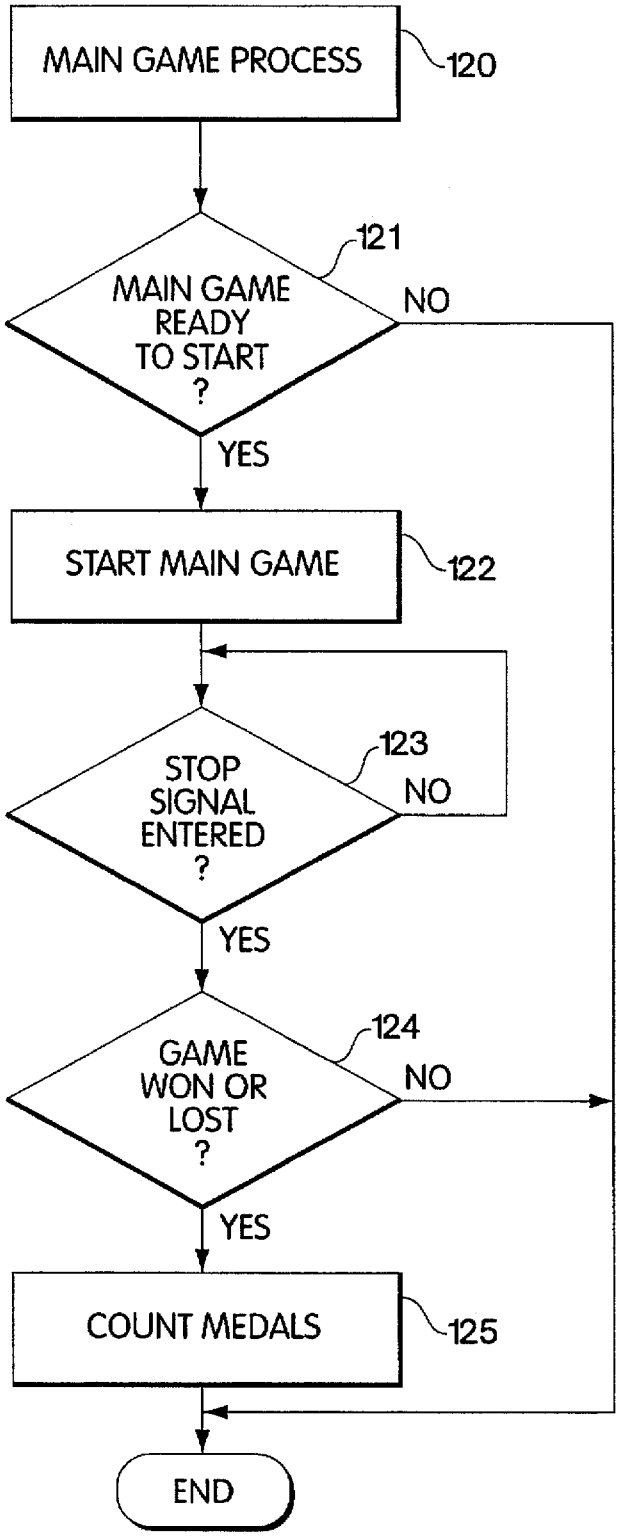
FIG. 6 is a flow diagram showing the main game process.
Figure 7:
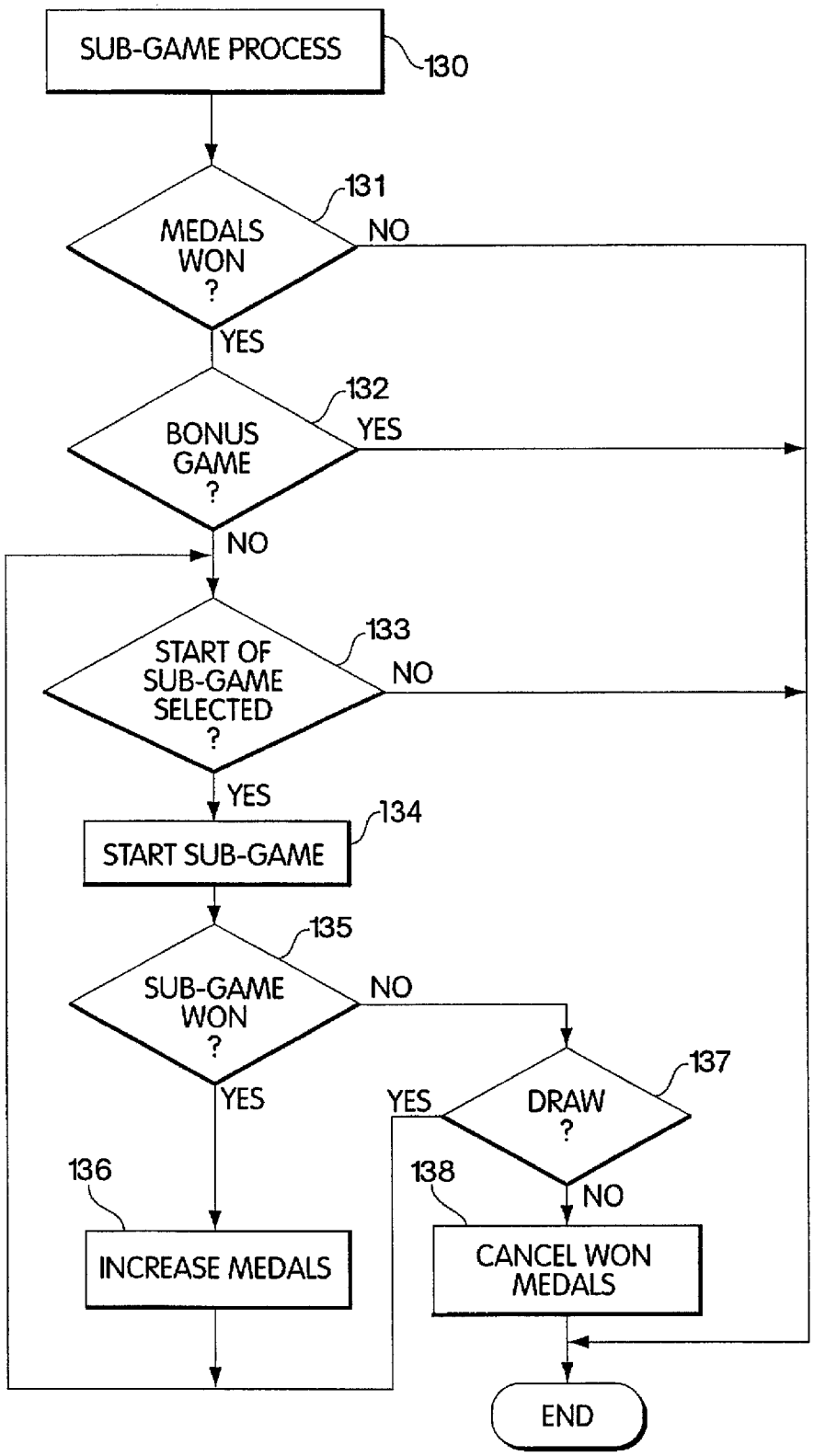
FIG. 7 is a flow diagram showing the sub-game process.
Figure 8:
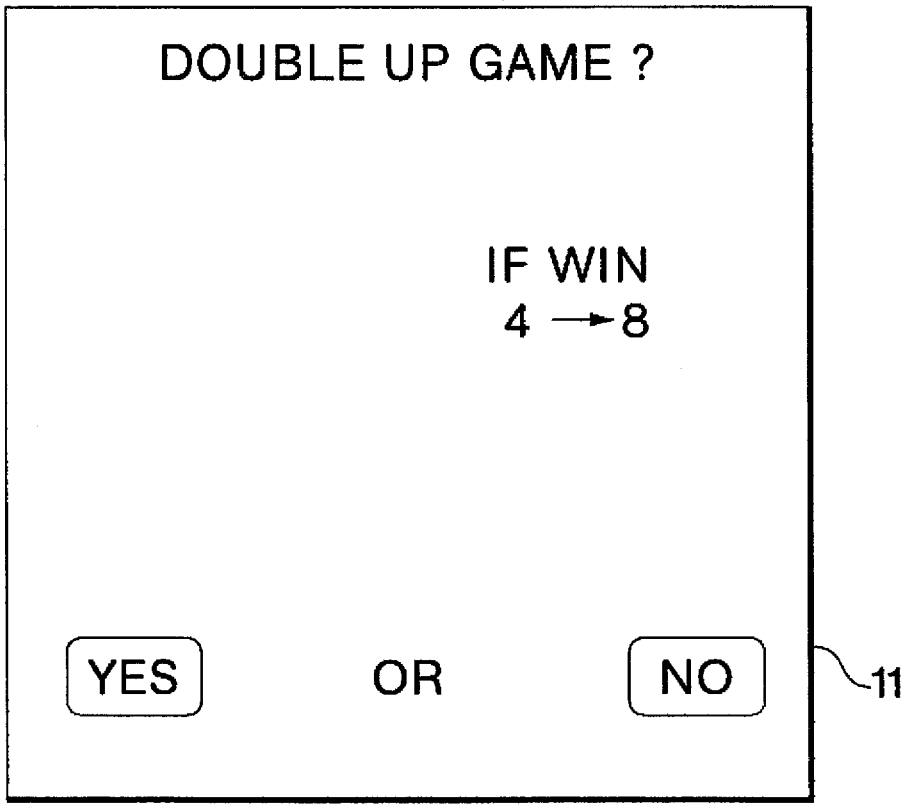
FIG. 8 is a front view of the display screen in its sub-game session.
Figure 17:
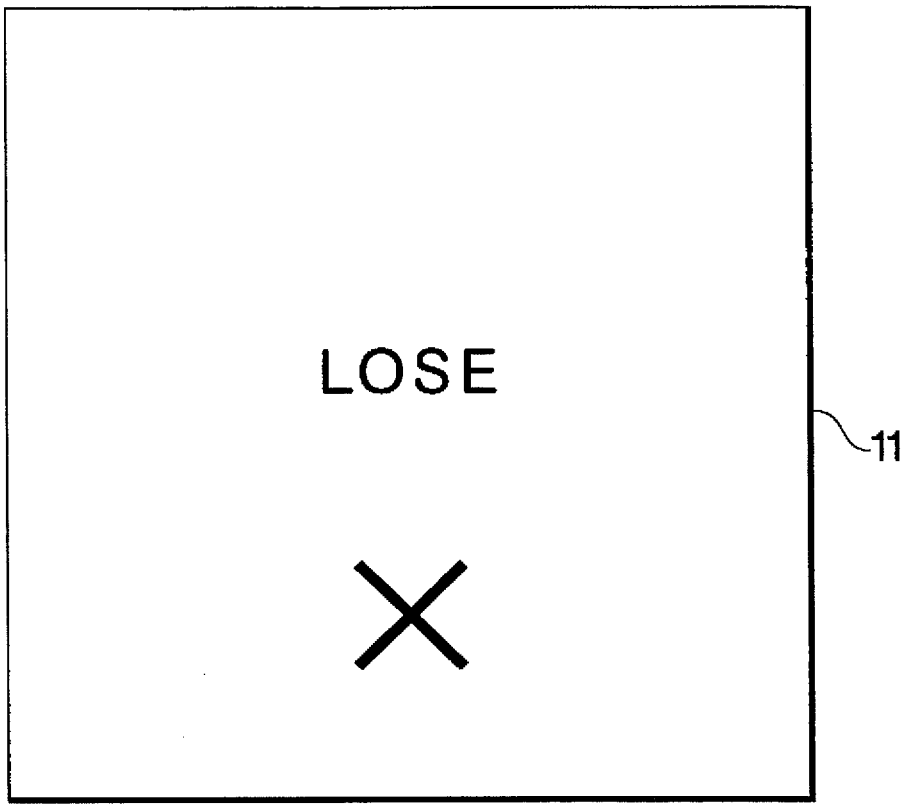
FIG. 17 is an explanatory view of the screen on which the sub-game is in progress.
Figure 18:
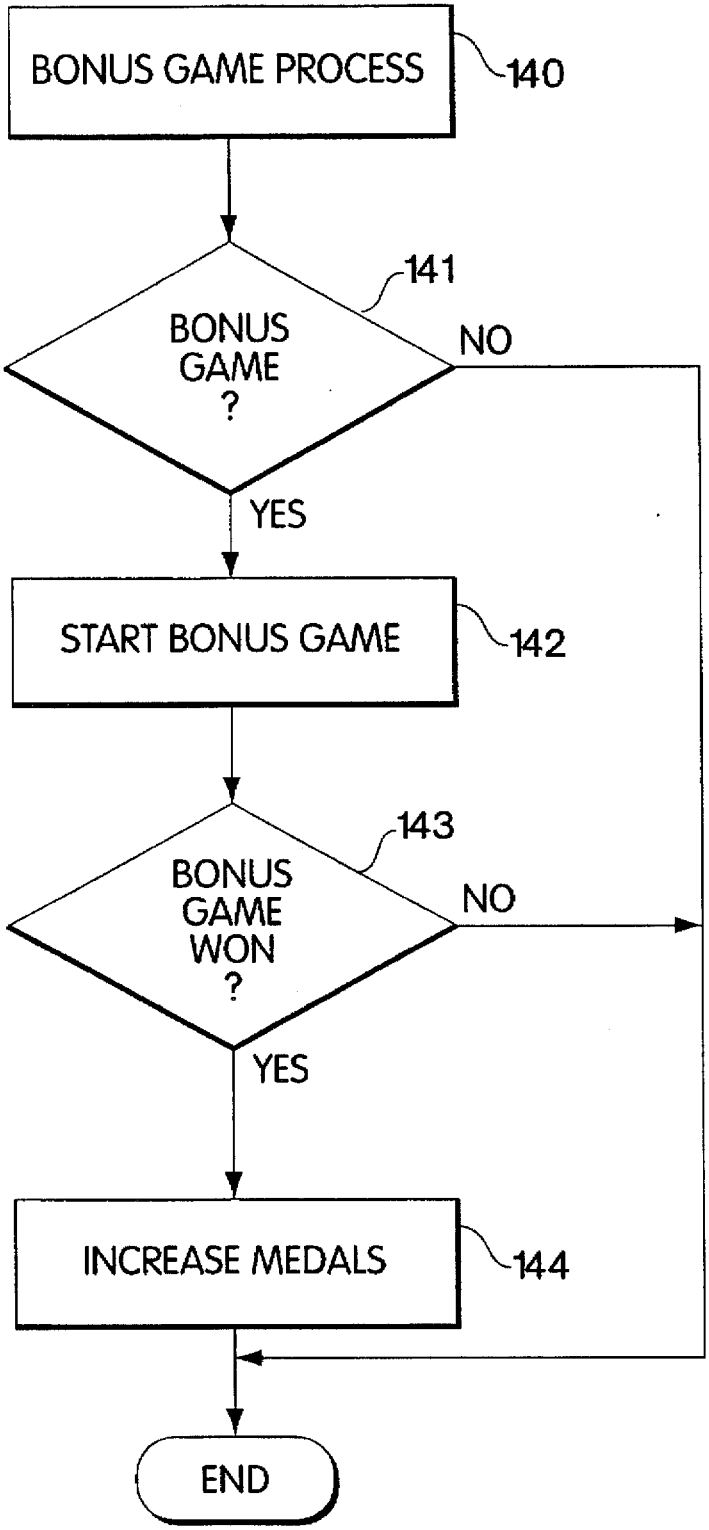
FIG. 18 is a flow diagram showing a bonus game process.
Figure 19:
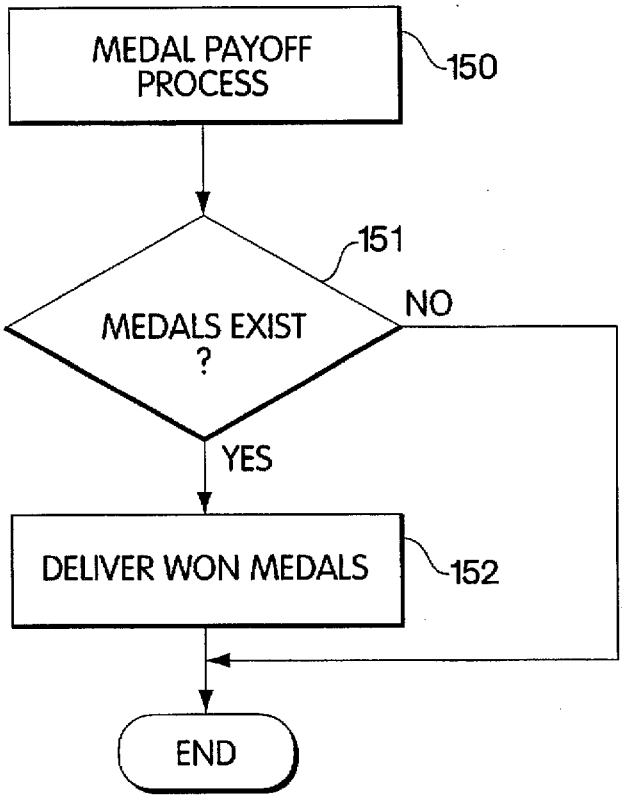
FIG. 19 is a flow diagram showing the process of game medal payoff.

FIG. 1 is the diagrammatic front view of the picture amusement apparatus. FIG. 2 is the front view of the display screen on which the main game is currently running. FIG. 3 is the front view of the display screen on which the sub-game is running. FIG. 4 is the enlarged front view of the operation panel. FIG. 5 is the flow diagram showing the general operation of the picture amusement apparatus. FIG. 6 is the flow diagram showing the main game process. FIG. 7 is the flow diagram of the sub-game process. FIG. 8 is the explanatory view of the sub-game selection screen. FIGS. 9 through 17 show the screens on which the sub-game is in progress. FIG. 18 is the flow diagram of the bonus game process. FIG. 19 is the flow diagram of the medal payoff process.

Designated 10 in FIG. 1 is the picture amusement apparatus. The picture amusement apparatus 10 has on its center a display screen 11 which is square. Disposed below the display screen 11 is an operation panel 12 having six substantially square switches. Disposed above the display screen 11 are three decorative lamps 13, on the center and left-hand and right-hand sides of the apparatus.

The picture amusement apparatus 10 has a medal inlet slot 14 having a medal sensor (not shown) on the left-hand side of the apparatus as shown in FIG. 1. Disposed to the left of the medal inlet slot 14 is a retrieval switch 15 that retrieves a medal that Jams in the medal inlet slot 14.

The picture amusement apparatus 10 has, below the operation panel 12, a title board 16, constructed of a material capable of transmitting light and bearing the name of the game apparatus and decorative patterns as shown in FIG. 1. Disposed below the title board 18 is a medal payoff slot 17 through which medals as the profit won by the player are delivered. Disposed blow the medal payoff slot 17 is a medal tray 18 for temporarily receiving the medals delivered through the medal payoff slot 17.

The picture amusement apparatus 10 is provided with an unshown credit mechanism that allows the player to store temporarily medals won by the player as the profit.

The display screen 11 is constructed of a color CRT in this embodiment. Alternatively, the display screen 11 may be constructed of an STN-type or TN-type color liquid crystal display.

The display screen 11 comprises three partitions, partition 20 on the left-hand side, partition 21 on the center and partition 22 on the right-hand side on each row, and has three rows in total.

Each of the partitions 20 through 22 is capable of scrolling fast a plurality of types of symbols including numerals. Each of the partitions 20 through 22 is capable of stopping symbols at three rows: the top, middle and bottom rows.

The display screen 11 is provided with five winning lines 30 through 34 as shown in FIG. 2. Three parallel winning lines 30 through 32 run horizontally across respectively the top, middle and bottom rows of each of the partitions 20 through 22. A winning line 33 extends diagonally across the screen 11 from the top left corner to the bottom right corner and a winning line 34 extends diagonally across the screen 11 from the top right corner to the bottom left corner. Both winning lines 33 and 34 intersect at the center partition at its middle row.

The five winning lines 80 through 34 work as an effective reference line, with respect to which the matching of symbols is analyzed about whether it is a winning matching of symbols or not, on condition that a game medal is dropped into the slot. Specifically, when a single game medal is dropped into the slot, the winning line 31 along the middle row is activated as a reference line. When two medals are inserted, the three winning lines 30 through 32 on the top, middle and bottom rows are activated as reference lines. When three medals are inserted, diagonally inclined winning lines 33, 34 in addition to the three lines 30 through 32 are activated as reference lines.

The left-hand partitions 20 are switched at the start of the sub-game. When in the sub-game, the bottom row of the left-hand partition 20 is switched to the left-hand side select numeral indicator partition 40 enclosed by a square outline as shown in FIG. 3. The left-hand side select numeral indicator partition 40 fast sequentially scrolls numerals within a predetermined range, in this embodiment 0 through 9.The center partitions 21 are switched at the start of the sub-game. When in the sub-game, the center partition 21 at the middle row is switched to the basic numeral screen partition 50 enclosed by a square outline as shown in FIG. 3. The basic numeral screen partition 50 fast sequentially scrolls numerals within a predetermined range, in this embodiment 0 through 9.

The center partition 21 at the bottom row is switched to the center select numeral indicator partition 41 enclosed by a square outline as shown in FIG. 3. The center select numeral indicator partition 41 fast sequentially scrolls numerals within a predetermined range, in this embodiment 0 through 9.

The right-hand partitions 22 are also switched at the start of the sub-game. When in the sub-game, the right-hand partition 22 at the bottom row is switched to the right-hand side select numeral indicator partition 42 enclosed by a square outline as shown in FIG. 3. The right-hand side select numeral indicator partition 42 fast sequentially scrolls numerals within a predetermined range, in this embodiment 0 through 9.

The operation panel 12 is provided with six switches, A through F in that order from the left as shown in FIGS. 1 and 4.

The A switch 60 functions as the main start switch 61 for starting the moving display in each of the screen partitions 20 through 22 in the main game or slot machine game in this embodiment. The A switch 60 also functions as a basic scroll control switch 62 for starting or stopping the scrolling of the numerals in the basic numeral screen partition 50 in the sub-game.

The B switch 70 functions as a left stop switch 71 for stopping the moving display on the left-hand side partitions 20 in the slot machine game, functions as a sub-game selection switch 72 for shifting to the sub-game session, and functions as a left select scroll stop switch 73 for stopping the scrolling of the numerals in the left-hand side select numeral indicator partition 40 in the sub-game.

The C switch 80 functions as a center stop switch 81 for stopping the moving display in the center partitions 21 in the slot machine game, and also functions as a center select scroll stop switch 82 for stopping the scrolling of the numerals in the center select numeral indicator partition 41 in the sub-game.

The D switch 90 functions as a right stop switch 91 for stopping the moving display in the right partitions 22 in the slot machine game, functions as a main game selection switch 92 not to shift to the sub-game, and also functions as a right select scroll stop switch 93 for stopping the scrolling of the numerals in the right-hand side select numeral indicator partition 42 in the sub-game.

The E switch 100 is a credit use switch 101 for using credit medals remaining deposited in the apparatus. One single switching operation allows a single game medal to be dropped in for game playing.

The F switch 110 is a maximum credit use switch 111 for using credit medals remaining deposited in the apparatus. The difference from the credit use switch 101 is that a single switching operation permits use of the maximum number of medals, three medals in this embodiment.

The picture amusement apparatus 10 has an electronic control unit (not shown) which controls the display screen 11 and receives signals for process from the external switches including the main start switch 61. The electronic control unit contains a microcomputer constructed of a CPU, and a ROM and RAM which store a program and the like.

The content of the ROM is now discussed.

The program is organized in four main processes as shown in FIG. 5: a main game process 120 for generally handling normal slot machine game, a sub-game process 130 in succession to the main game process 120, for performing sub-game process that increases or decreases the number of medals scored in the main game, a bonus game process 140 that is performed when a bonus game is won in the sub-game process 130, and a medal payoff process 150 for paying off the game medals, if any, to the player after the bonus game process 140.

Referring now to the flow diagram in FIG. 6, the main game process 120 is discussed.

At step 121, a determination is made of whether a slot machine game is ready to start or not. This determination is performed by the electronic control unit. In this embodiment, the electronic control unit determines whether a game medal is already dropped in the slot or not. Medals may be entered in one of three ways: dropping medals in the inlet slot 14, operating the credit use switch 101 and operating the maximum credit use switch 111. Depending on the number of medals entered, active winning lines among lines 30 through 34 are increased or decreased.

When step 121 determines that the slot machine game is now ready to start, namely, that a game medal is already entered, the process goes to step 122. The slot machine game starts at step 122. The slot machine game is run by the electronic control unit. With the main start switch pressed, the electronic control unit receives the start signal from the main start switch 81. The electronic control unit causes the display screen 11 to move fast continuously a plurality of symbols on each of the partitions 20 through 22.

The process goes to step 123, where a determination is made of Whether a stop signal is entered or not. This determination is performed by the electronic control unit. The electronic control unit constantly monitors the left stop switch 71, the center stop switch 81, and the right stop switch 91 to see if any of these switches has been operated.

When the electronic control unit determines that any of these stop switches has been operated, the process goes to next step 124, where a determination is made of whether the game result is win or lose. This determination is performed by the electronic control unit. The electronic control unit checks the matching of the symbols on the active winning lines, and determines whether or not the matching of the symbols at a half on each of the partitions 20 through 22 is one of the predetermined matchings. In this embodiment, if the same numbers are aligned on each of the active winning lines, for example, "333," "444," "555," "666," "777," the result of the play is a win. Furthermore, "777" is a win that permits a bonus game.

When the determination reveals that the game result is a win, the process goes to step 125. At step 125, the medals scored by the player is counted to complete the main game process 120. Then, the game sequence enters the sub-game process 130. The number of medals allowed as the profit for the player is four medals, in this embodiment.

On the other hand, when the determination reveals that the game result is a lose, for example, "143," "443," "523," "678,", no medals are given, and the main game process 120 is completed. The game sequence enters the sub-game process 130.

When step 123 reveals that no stop signal is entered, namely neither of the left, center and right switches 71, 81 and 91, has been operated, step 123 is repeated to check the presence of stop signal.

When, at step 121, the slot machine game is found to be not ready to start, namely no medals are entered yet, the main game process 120 is completed, and the game sequence enters the sub-game process 130.

Referring now to the flow diagram in FIG. 7, the sub-game process 130 is discussed.

At step 131, a determination is made of whether any medals are scored by the player as the profit. This determination is performed by the electronic control unit. The electronic control unit monitors the presence or absence of medals given to the player as the profit.

When step 131 determines the presence of medals, the process goes to step 132, where a determination is made of whether or not a bonus game is applicable. This determination is performed by the electronic control unit. In this embodiment, the matching of symbols that permits a bonus game is the matching or combination of 777, among other matchings that result in a win. When the matching on any active winning line is 777, the electronic control unit determines a bonus game.

When, at step 132, the determination reveals that the bonus game is not applicable, the process goes to step 133, where a determination is made of whether or not the start of a sub-game is selected. This determination is performed by the electronic control unit. The electronic control unit monitors the sub-game selection switch 72 to see if it is operated. In this embodiment, the display screen 11 presents messages "DOUBLE UP GAME?" "IF WIN 48" as shown in FIG. 8 to prompt the player to decide to go or not to go to the sub-game.

When, at step 133, the determination reveals that the sub-game is selected, the process goes to step 134. At step 134, the sub-game is initiated.

Referring now to FIGS. 9 through 17 and the flow diagram in FIG. 7 in particular, the sub-game is discussed.

Figure 9:
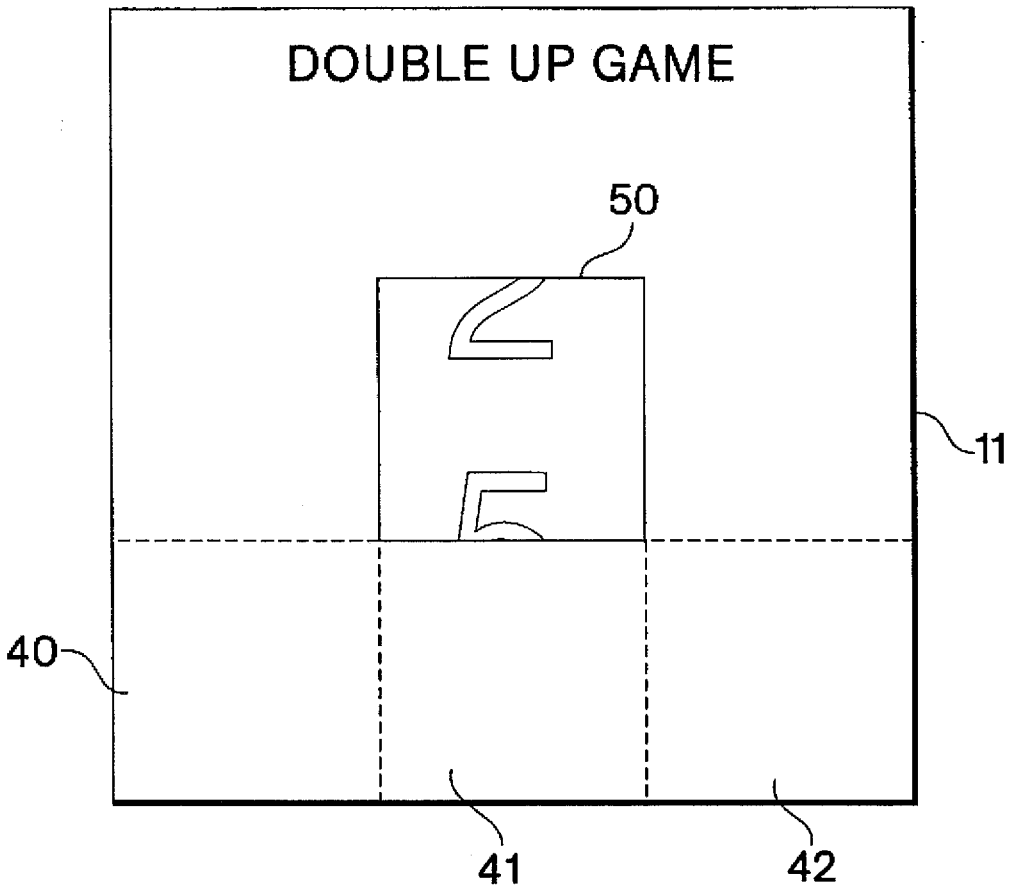
FIG. 9 is an explanatory view of the screen on which the sub-game is in progress.

When the sub-game is initiated as above, the display screen 11 gives in its center the basic numeral screen partition 50 to present the basic numeral as shown in FIG. 9.

The basic numeral screen partition 50 fast scrolls through predetermined numerals, 0 through 9, in this embodiment.

Figure 10:
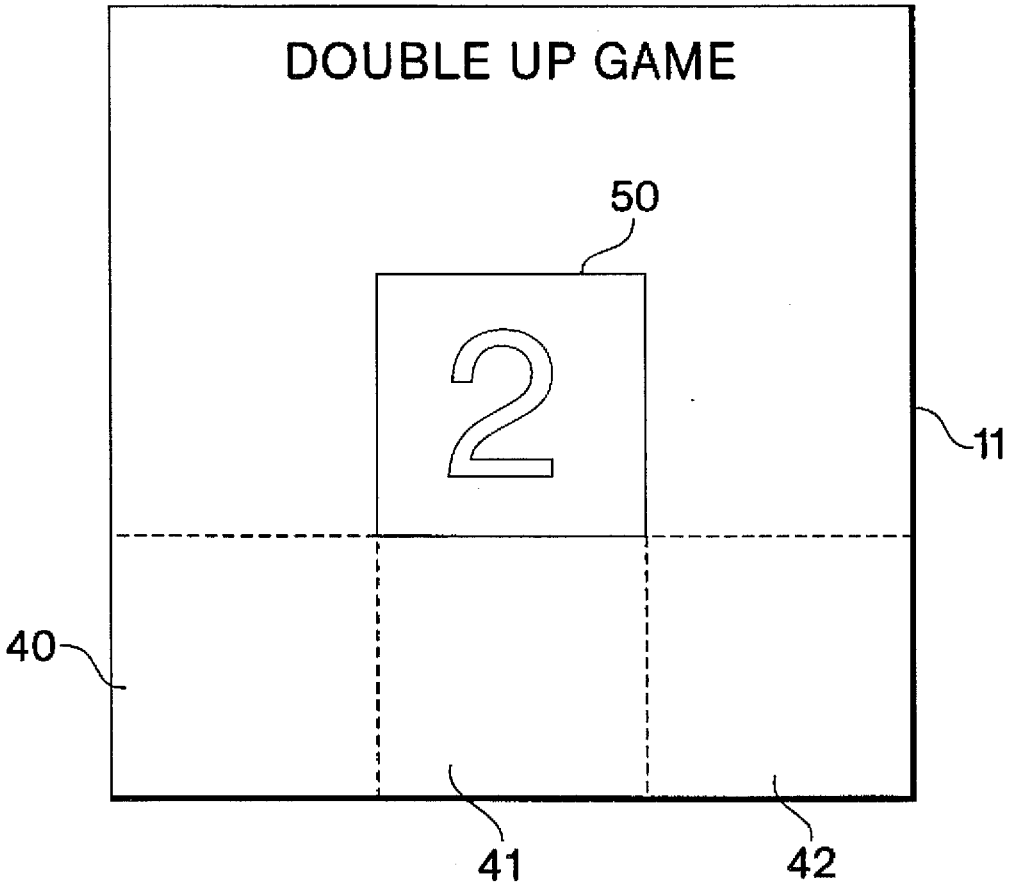
FIG. 10 is an explanatory view of the screen on which the sub-game is in progress.
Figure 11:
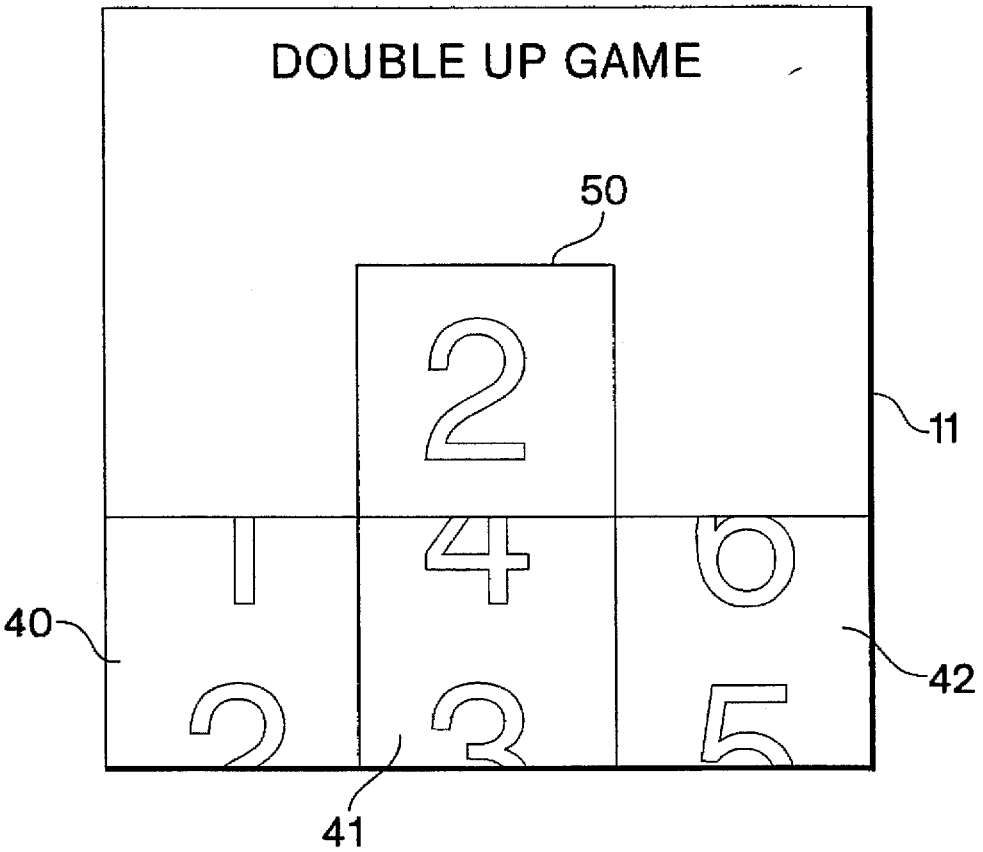
FIG. 11 is an explanatory view of the screen on which the sub-game is in progress.
Figure 12:
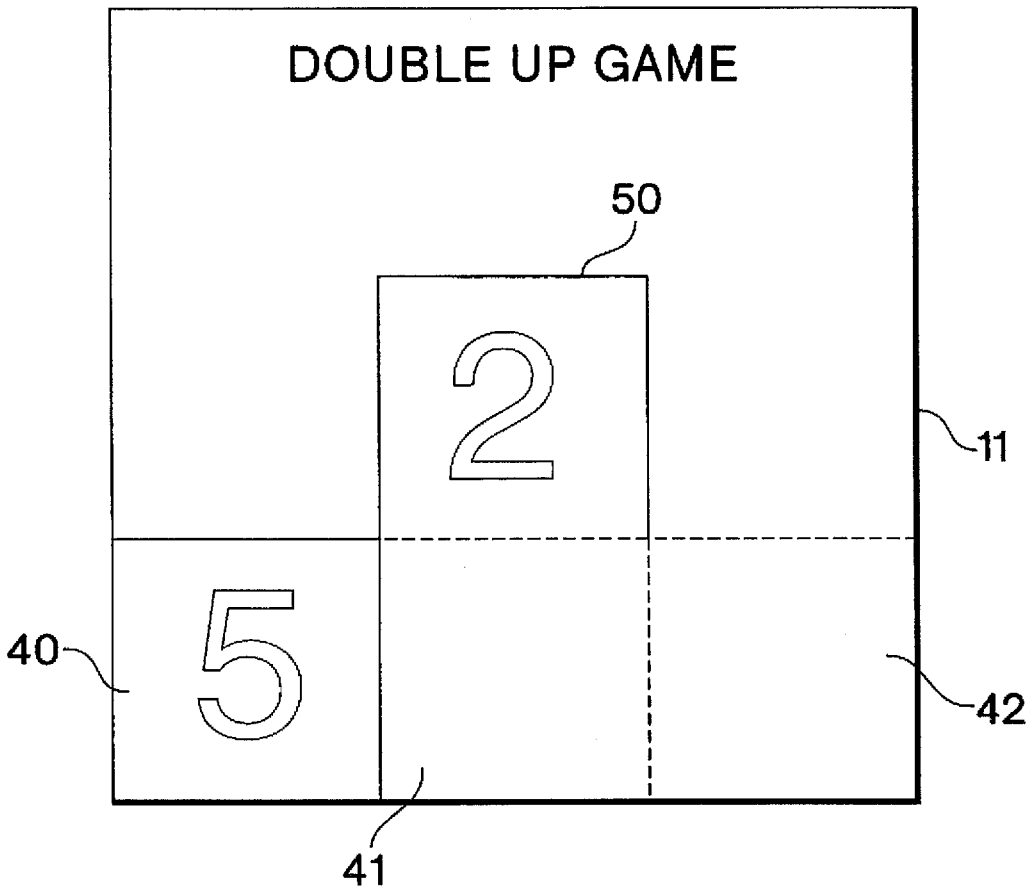
FIG. 12 is an explanatory view of the screen on which the sub-game is in progress.

When the basic scroll control switch 62 is manipulated with the basic numeral screen partition 50 fast scrolling through 0 through 9, the scrolling of the numerals in the basic numeral screen partition 50 stops. Any single numeral, "2" in this embodiment, is stopped and presented as shown in FIG. 10 and thus the basic numeral screen partition 50 is determined.

When the basic numeral is determined, the select numeral indicator partitions 40 through 42 corresponding to the bottom rows of the partitions 20 through 22 fast scroll through the numerals.

When any of the left select scroll stop switch 73, the center select scroll stop switch 82 and the right select scroll stop switch 93 is manipulated with the numerals being scrolled on each of the select numeral indicator partitions 40 through 42, the scrolling of the numeral on the corresponding screen partition among partitions 40 through 42 stops. A single numeral within the predetermined range appears still. When any of switches 82 and 93 is manipulated, a numeral appears still in the corresponding select numeral indicator partition. Since in this course of operation, the numerals are scrolled very fast on each of the select numeral partitions 40 through 42, even a skilled player has difficulty stopping any desired numerals stopped while tracking visually the scrolling numerals as he has difficulty with slot machine playing.

By manipulating the left select scroll stop switch 73, for example, the scrolling stops making the numeral "2" appear still in the left-hand side select numeral indicator partition 40 as shown in FIG.

The process goes to step 135, where the numeral "2" presented still in the basic numeral screen partition 50 is compared with the numeral "5" in the left-hand side select numeral indicator partition 40 to determine whether or not the result of the sub-game is a win.

The numeral "2" presented still in the basic numeral screen partition 50 is compared with the numeral "5" in the left-hand side select numeral indicator partition 40. This play of sub-game is a win because the numeral "5" in the left-hand side select numeral indicator partition 40 is greater.

Figure 13:
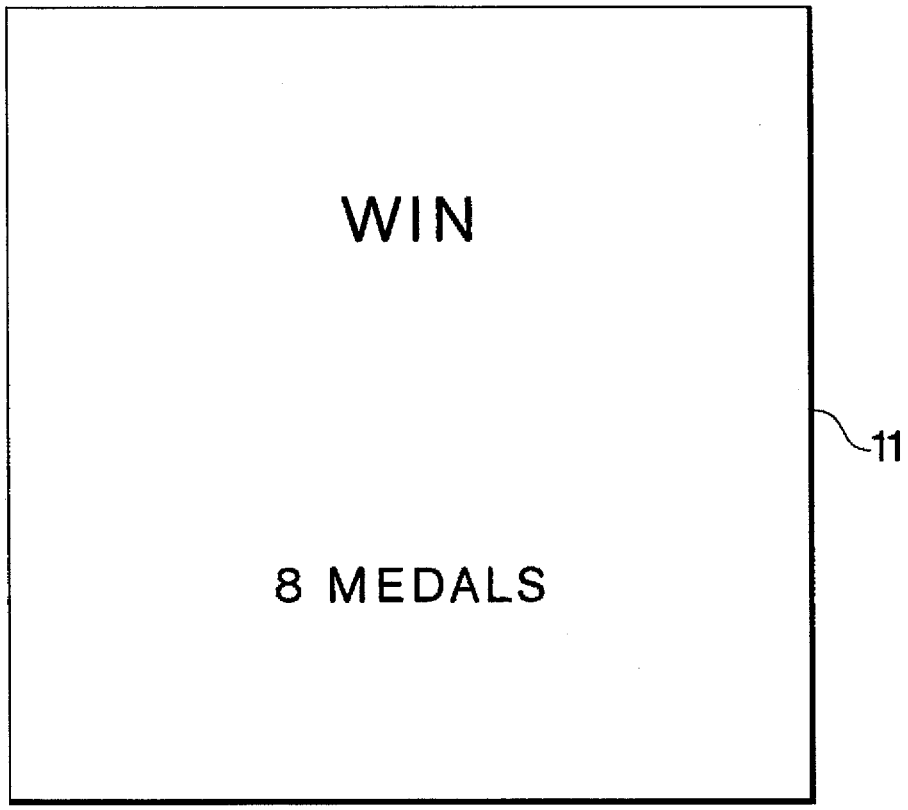
FIG. 13 is an explanatory view of the screen on which the sub-game is in progress.

When the determination at step 135 reveals that the sub-game result is a win, the process goes step 138. At step 136, the profit the player has gained is increased. In this embodiment, the player has already gained four medals as the profit, and this sub-game playing doubles it to eight medals. The display screen 11 presents a message reading "WIN 8 MEDALS" as shown in FIG. 13. When the number of medals is doubled, the process returns to step 133, where a determination is made of whether or not the start of a sub-game is selected. When the number of medals is doubled, whether to start over or stop the sub-game is at the option of the player.

Since whether to start over or stop the sub-game is at the option of the player, the player enjoys the sub-game playing to the player's preference.

Figure 14:
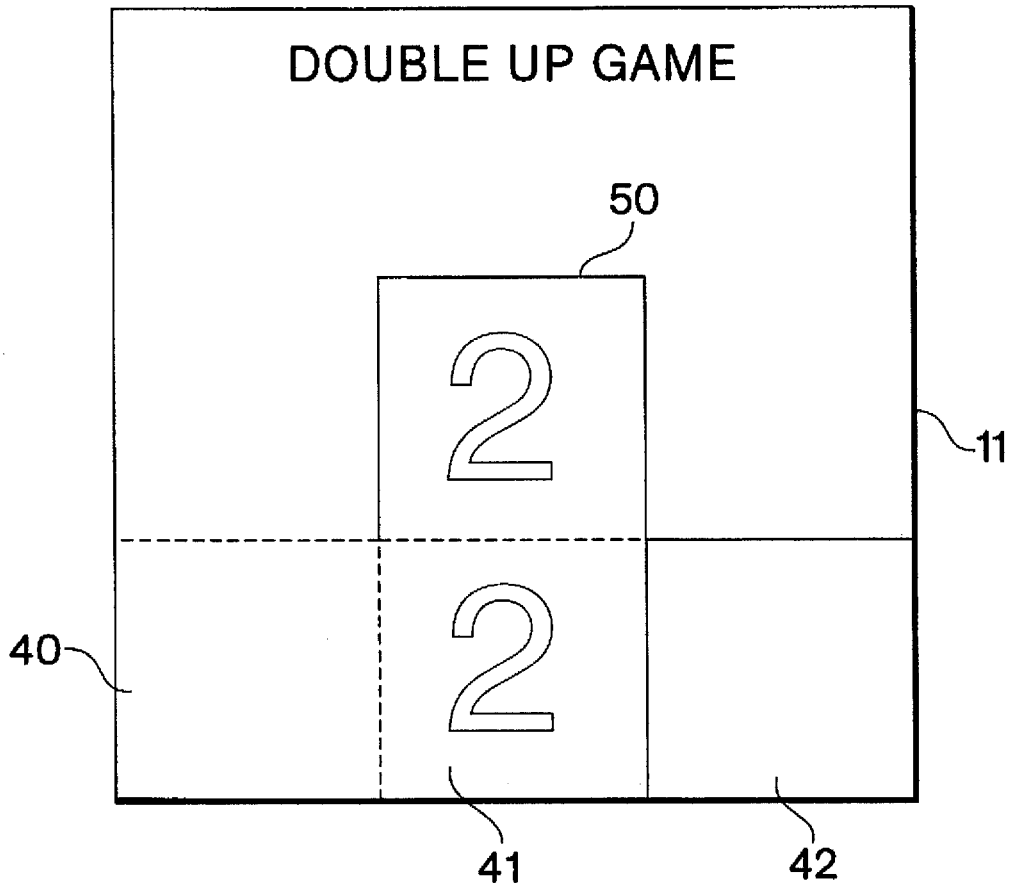
FIG. 14 is an explanatory view of the screen on which the sub-game is in progress.
Figure 15:
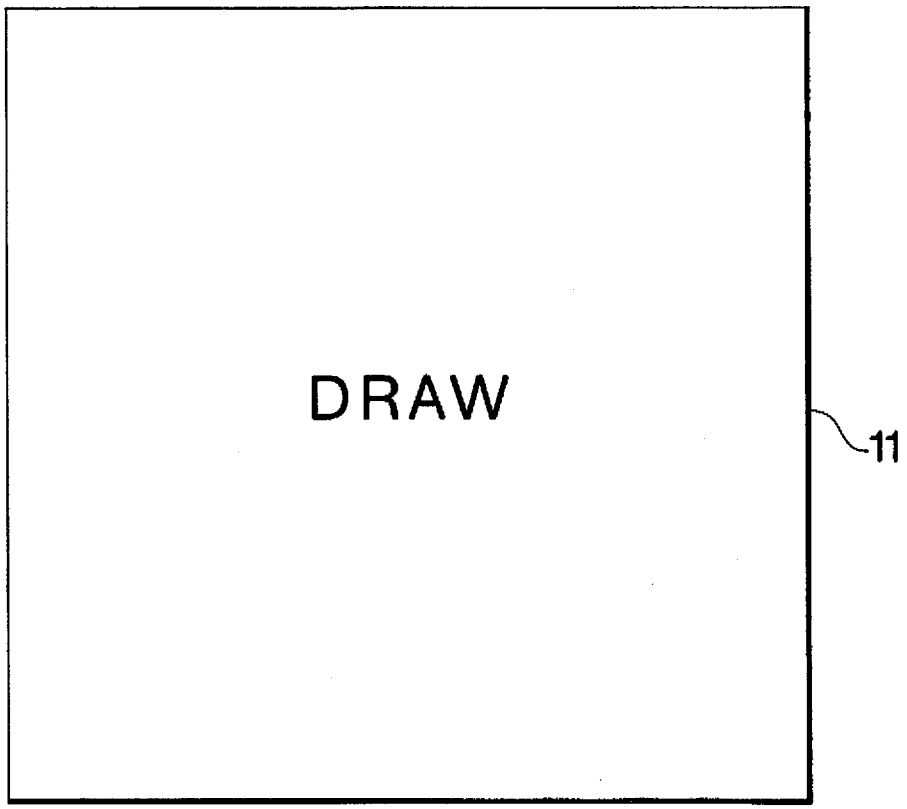
FIG. 15 is an explanatory view of the screen on which the sub-game is in progress.

When the center select scroll stop switch 82 is manipulated, the numeral "2", for example, appears still in the center select numeral indicator partition 41 as shown in FIG. 14.

At step 135, the numeral "2" presented still in the basic numeral screen partition 50 is compared with the numeral "2" in the center select numeral indicator partition 41. In this case, both numerals are equal, and the result of this sub-game playing is not a win. The process then goes to step 137.

At step 137, a determination is made of whether or not the result of the sub-game playing is a draw. In this case, it is a draw, and the enlarged word DRAW is presented in the center of the display screen 11 as shown in FIG. The process returns to step 133, where a determination is made again of whether or not the start of a sub-game playing is selected. In the case of a draw, also, a sub-game playing starts over at the player's option.

Figure 16:
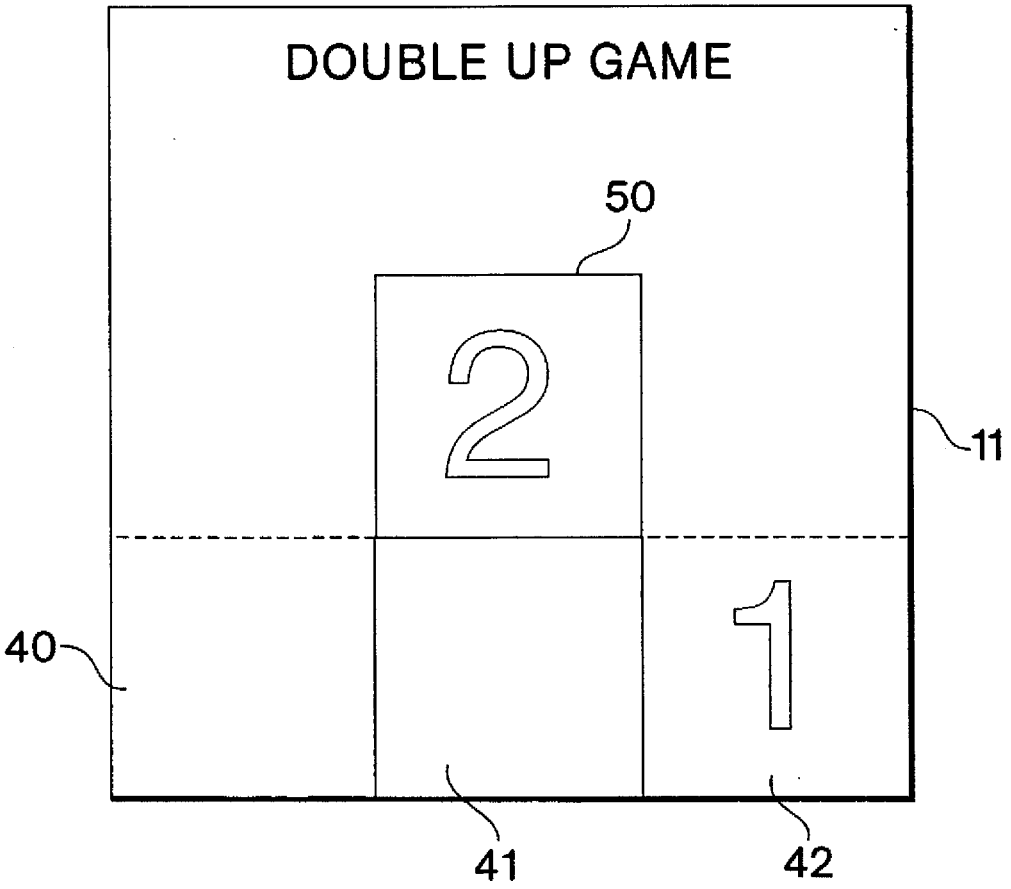
FIG. 16 is an explanatory view of the screen on which the sub-game is in progress.

When the right select scroll stop switch 93 is manipulated, the numeral "1", for example, appears still in the right-hand side select numeral indicator partition 42 as shown in FIG. 16.

At step 135, the numeral "2" presented still in the basic numeral screen partition 50 is compared with the numeral "1" in the right-hand side select numeral indicator partition 42. In this case, the numeral "1" in the right-hand side select numeral indicator partition 42 is smaller, and the result of this sub-game playing is not a win. The process then goes to step 137.

At step 137, a determination is made of whether or not the result of the sub-game playing is a draw. In this case, it is not a draw, and the process goes to step 138. The profit the player has already scored is canceled out. In this embodiment, the player loses all four medals once scored. The display screen 11 presents in its center the word LOSE and the character X as shown in FIG. 17, and the sub-game process 130 is thus completed. The game sequence enters the following bonus game process 140.

When the already described step 133 reveals that the start of a sub-game is not selected, namely, the main game selection switch 92 is manipulated, the sub-game process 130 ends. The game sequence enters the bonus game process 140.

When the already described step 132 reveals that the bonus game is applicable, the sub-game process 130 ends, and the game sequence enters the bonus game process 140.

Referring now to the flow diagram in FIG. 18, the bonus game process 140 is discussed.

At step 141, a determination is made of whether or not the result of the main game satisfies the bonus game requirement. This determination is performed by the electronic control unit. The electronic control unit determines that the medals as the profit gained by the player agree with the matching of the symbols for the bonus game. In this embodiment, among the matchings of the symbols that result in a win, the combination of 777 is the matching required for shifting to the bonus game. Therefore, when the combination 777 appears still on any of the active winning lines, the resulting profit is judged to satisfy the bonus game requirement.

When step 141 determines that the bonus game requirement is satisfied, the process goes to step 142. At step 142, the bonus game is initiated. In this embodiment, the bonus game means that a predetermined plays of slot machine games are allowed at a higher probability of win.

The process leaves step 142 and goes to step 143, where a determination is made of whether or not the result of the bonus game is a win. This determination is performed by the electronic control unit. The electronic control unit checks the matching of the symbols on each of the active winning lines, and determines whether or not the matching of the symbols on the active winning line agrees with a predetermined matching. In this embodiment, the same numerals, for example, "333," "444," "555," "666," "777," and the like are a winning matching. The matching 777 is one of the winning matchings, but, during bonus game, does not work for shifting the sequence to the bonus game.

When the determination reveals that the bonus game playing is a win, the process goes to step 144. At step 144, the number of medals as the profit for the player is increased based on the bonus game result. The bonus game process 140 ends, and the game sequence enters the next medal payoff process 150.

When the determination reveals that the bonus game playing is not a win, the bonus game process 140 ends. The game sequence enters the next medal payoff process 150.

When step 141 determines that the bonus game requirement is not satisfied, the bonus game process 140 ends. The game sequence enters the next medal payoff process 150.

Referring now to the flow diagram in FIG. 19, the medal payoff process 150 is discussed.

At step 151, a determination is made of whether or not there exist medals as the profit won by the player. This determination is performed by the electronic control unit.

When the electronic control unit determines that there exist medals, the process leaves step 151 and goes to step 152. At step 152, the medals are delivered out through the medal payoff slot 17 into the medal tray 18. This completes the medal payoff process 150, and the game sequence according to the present invention is thus completed.

When the determination reveals that there are no medals won, no medal payoff is performed. The medal payoff process 150 ends, and the game sequence according to the present invention is now completed.

Figure 20:
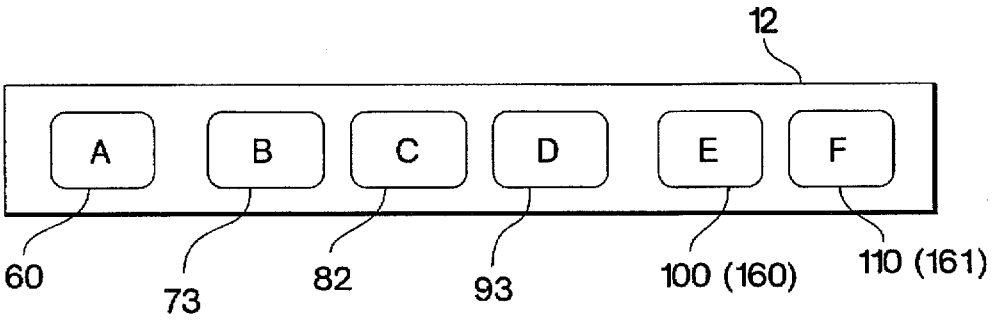
FIG. 20 is an enlarged front view of the operation panel according to a second embodiment of the present invention.
Figure 21:
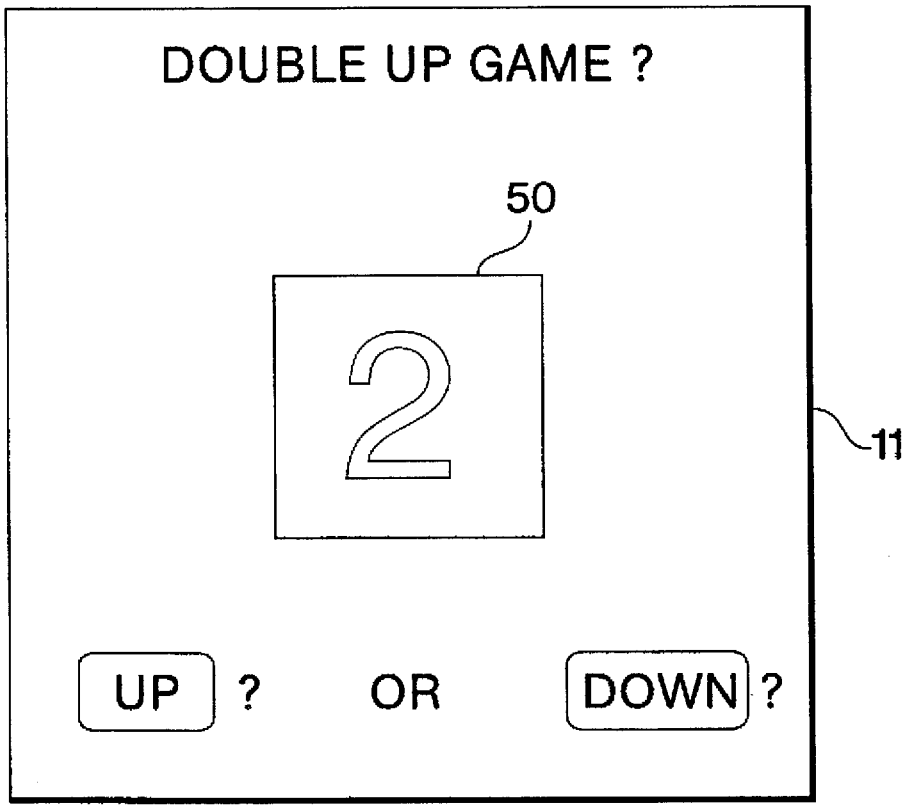
FIG. 21 shows the screen on which the increase criteria in the sub-game is selected according to the second embodiment of the present invention.
Figure 22:
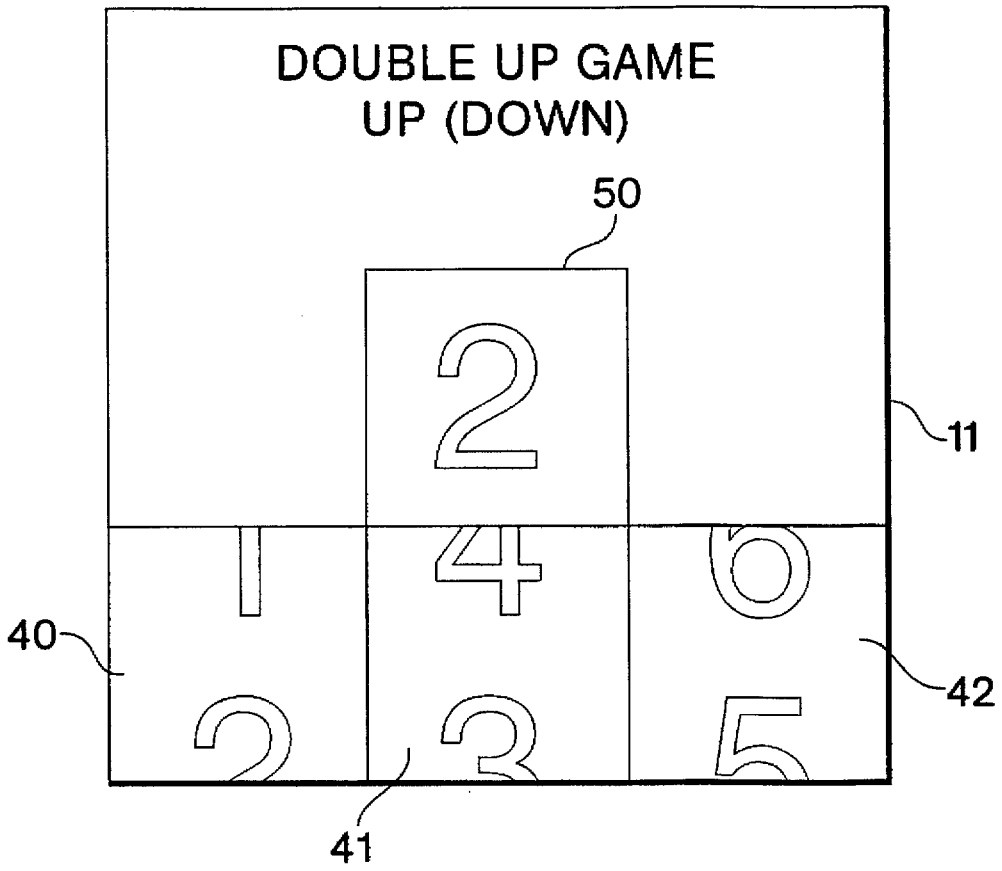
FIG. 22 shows the screen on which the sub-game is in progress according to the second embodiment.
Figure 23:
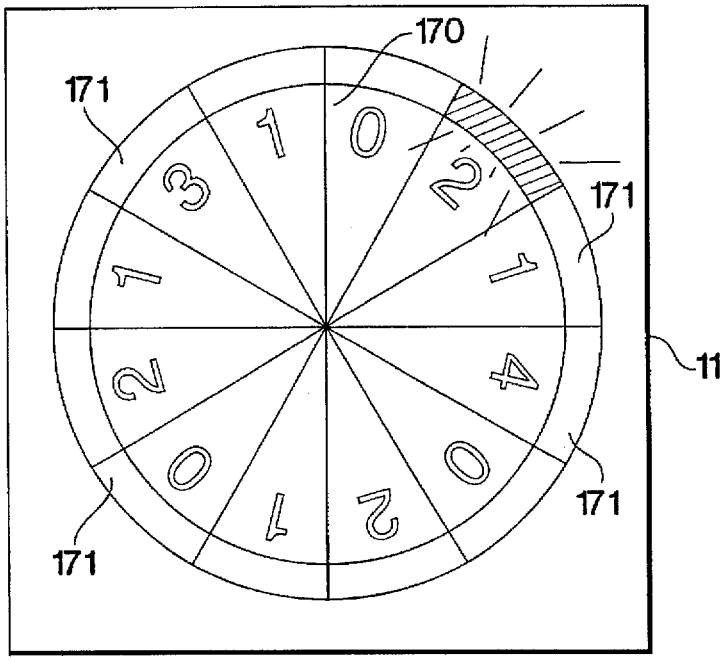
FIG. 23 shows the screen on which the sub-game is in progress according to a third embodiment of the present invention.
Figure 24:
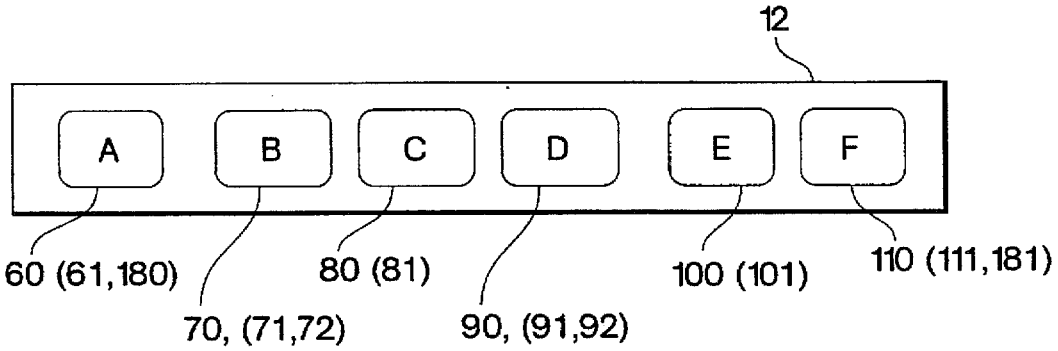
FIG. 24 is an enlarged front view of the operation panel according to the third embodiment.
Figure 25:
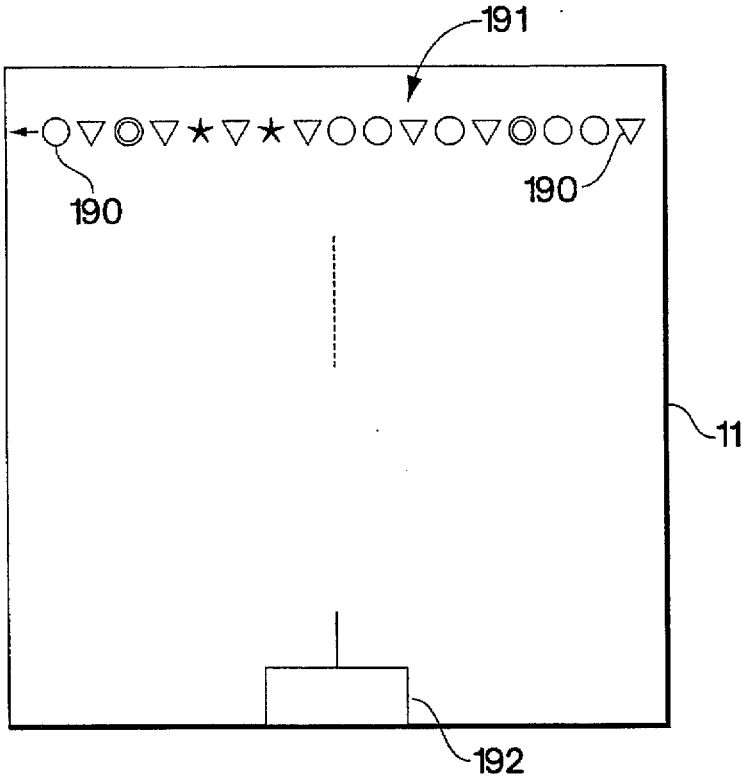
FIG. 25 shows the sub-game on screen according to a fourth embodiment of the present invention.
Figure 26:
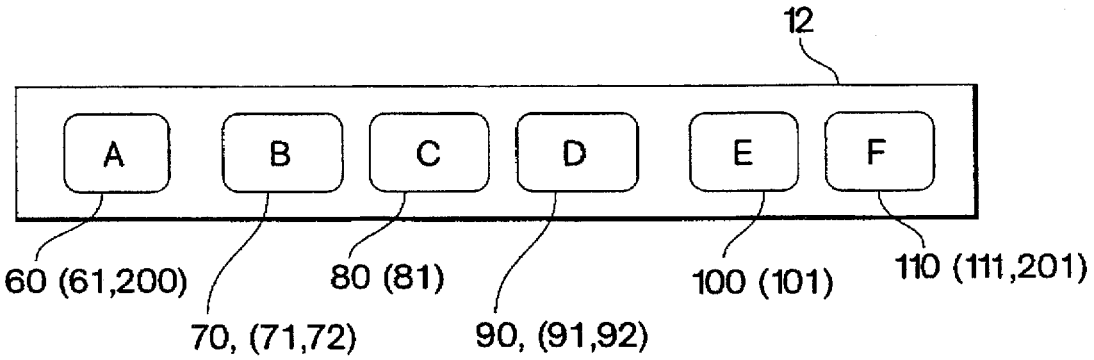
FIG. 26 is an enlarged front view of the operation panel according to the fourth embodiment.
Figure 27:
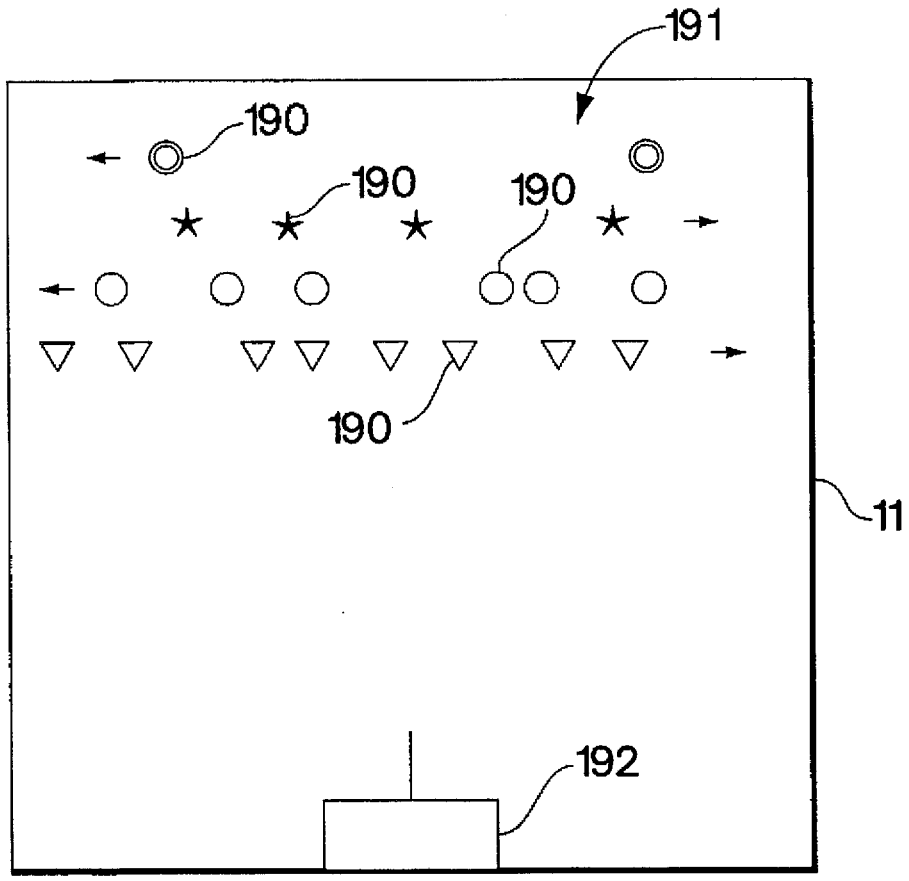
FIG. 27 shows the sub-game on screen according to a fifth embodiment of the present invention.
Figure 28:
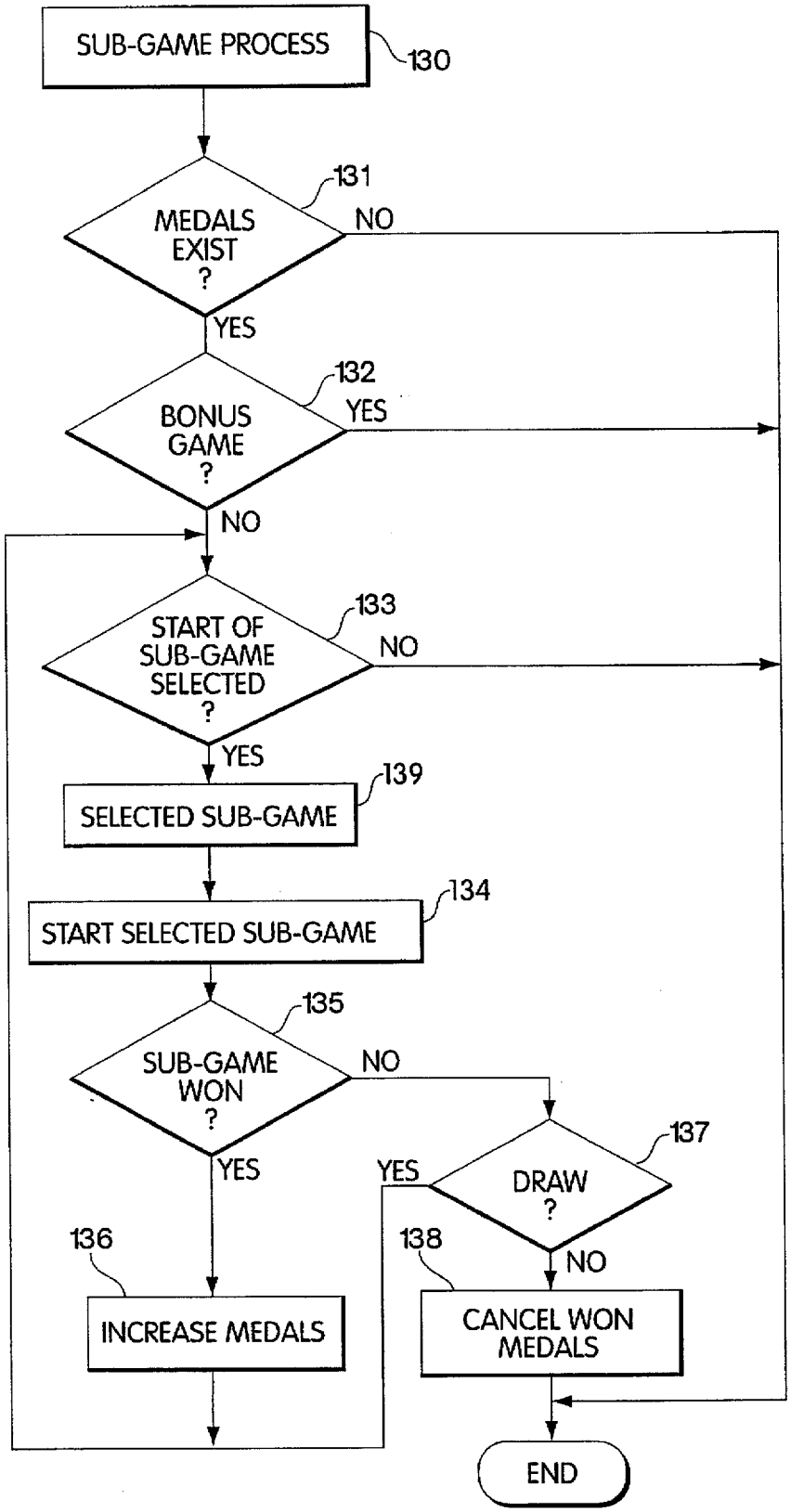
FIG. 28 is a flow diagram showing the sub-game of a sixth embodiment of the present invention.

Referring now to FIGS. 20 through 28, the other embodiments of the present invention related to the sub-game are now discussed. FIGS. 20 through 22 show the second embodiment of the present invention. FIGS. 23 and 24 show the third embodiment. FIGS. 25 and 28 show the fourth embodiment. FIG. 27 shows the fifth embodiment. FIG. 28 shows the sixth embodiment.

Referring to FIGS. 20 through 22, the second embodiment related to the sub-game is now discussed. FIG. 20 is the enlarged front view of the operation panel. FIG. 21 shows the screen on which the increase criteria in the sub-game is selected. FIG. 22 shows the screen on which the sub-game is in progress.

The display screen 11 in connection with the sub-game in the second embodiment remains essentially unchanged from that of the first embodiment, and the discussion for it is not repeated.

The difference from the first embodiment is that the player has the option to select profit increase criteria in the second embodiment.

Namely, In the second embodiment, whether the profit increase criteria is on condition that any of the select numerals presented still in the select numeral indicator partitions 40 through 42 is greater than the basic numeral presented still in the basic numeral screen partition 50 or on condition that the any of the select numerals is smaller than the basic numeral is at the player's option.

As in the first embodiment, the operation panel 12 is provided with six switches, A through F in that order from the left in the second embodiment. The A through F switches have the same functions as in the first embodiment. Furthermore, the E switch 100 and F switch 110 have the following additional functions.

The E switch 100 is a smaller-than-basic-numeral criteria switch 160 for selecting the increase criteria that is on condition that any of the select numerals presented still in the select numeral indicator partitions 40 through 42 is smaller than the basic numeral presented still in the basic numeral screen partition 50.

The F switch 110 Is a greater-than-basic-numeral criteria switch 161 for selecting the increase criteria that is on condition that any of the select numerals presented still in the select numeral indicator partitions 40 through 42 is greater than the basic numeral presented still in the basic numeral screen partition 50.

When the start of a sub-game is selected in the second embodiment, the display screen 11 gives in its center the basic numeral screen partition 50 for presenting the basic numeral as shown in FIG. 21.

The basic screen partition 50 fast scrolls through numerals within a predetermined range, 0 through 9 in this embodiment as shown in FIG.

When the basic scroll control switch 62 is manipulated with 0 through 9 scrolled fast on the basic screen partition 50, the scrolling of the numerals stops. Any numeral within the predetermined range is presented still, for example, the numeral "2" comes to a halt as shown in FIG. 21. This is used as the basic numeral.

When the basic numeral is determined, the display screen 11 gives on its bottom a message "UP OR DOWN" as shown in FIG. 21. Whether the increase criteria is on condition that the select numeral is greater than the basic numeral or on condition that the select numeral is smaller than the basic numeral is at the player's option.

The greater-than-basic-numeral criteria switch 161 is manipulated when the player wants to select "UP," namely, wants to increase the profit on condition that the select numeral is greater than the basic numeral.

When the greater-than-basic-numeral criteria switch 161 is manipulated, each of the select numeral indicator partitions 40 through 42 fast scrolls through numerals with the word "UP" presented on the top left of the screen 11 as shown in FIG. 22.

When any of the left select scroll stop switch 73, the center select scroll stop switch 82 and the right select scroll stop switch 93 is manipulated with the numerals being scrolled on each of the select numeral indicator partitions 40 through 42, the scrolling of the numeral on the corresponding screen partition among partitions 40 through 42 stops. A single numeral within the predetermined range comes to a halt on the corresponding screen partition.

Then, in the same manner as in the first embodiment, the basic numeral stopped and presented in the basic numeral screen partition 50 is compared with the select numeral stopped and presented in any of the select numeral indicator partitions 40 through 42.

Since the player has manipulated the greater-than-basic-numeral criteria switch 161, the profit already won by the player is further increased when the select numeral is greater than the basic numeral. When the select numeral is smaller than the basic numeral, the player loses all the profit once won. When the select numeral is equal to the basic numeral, the result is a draw and the profit once won is returned as it is.

The smaller-than-basic-numeral criteria switch 160 is manipulated when the player wants to select "DOWN," namely, wants to increase the profit on condition that the select numeral is smaller than the basic numeral.

When the smaller-than-basic-numeral criteria switch 160 is manipulated, the profit already won by the player is increased with the select numeral being smaller than the basic numeral. When the select numeral is greater than the basic numeral, the profit once won by the player is canceled out. When the select numeral is equal to the basic numeral, the result is a draw as in the case of "UP," and the profit once won by the player is returned as it is.

As described above, two profit increase criteria are at the player's option: the medals as the profit won by the player Is increased on condition that the select numeral is greater than the basic numeral or on condition that the select numeral is smaller than the basic numeral. The player is even more free from feeling unfairness about the result of the game, compared with the first embodiment.

The third embodiment of the present invention related to the sub-game is discussed referring to FIGS. 23 and 24.

FIG. P. 8 is the explanatory view of the sub-game screen. FIG. 24 is the enlarged front view of the operation panel.

The display screen 11 in the sub-game according to the third embodiment presents a symbol screen 170 which is a dartboard-like circle divided into 12 equally angled sectors. The sectors bear a plurality of symbols. In this embodiment, each sector is numbered with one of the numerals, 1 through 4. Also, each sector has on its arc portion an illumination partition 171.

When an illumination partition 171 lights, its corresponding numeral at the same lit sector is active when a sub-game starts, an illumination partition 171 starts blinking on and off. The illumination partition 171 stops blinking, and the next illumination partition 171 starts blinking. The blinking action is thus taken over by following sectors, one after another, in a roulette fashion, possibly in a clockwise direction.

When blinking, namely rotating stops at one of the illumination partitions 171 of the symbol screen 170, that illumination partition 171 then continuously lights indicating that its corresponding numeral is active.

As detailed below, the third embodiment in connection with the sub-game is different from the first and second embodiments in that whether the profit already won by the player is further increased or completely lost is determined by the type of symbol stopped and indicated on the symbol screen 170.

As in the first embodiment, the operation panel 12 in the third embodiment is provided with six switches, A through F switches in that order from the left as shown in FIG. 24. The functions of the A through F switches are as follows:

The A switch 60 functions as the main start switch 61 for starting the moving display in each of the screen partitions 20 through 22 in the main game or slot machine game in this embodiment. The A switch 80 also functions as a symbol movement start switch 180 for starting the movement of the symbols in the symbol screen 170 in the sub-game.

The B switch 70 functions as a left stop switch 71 for stopping the moving display on the left-hand side partitions 20 in the slot machine game, and functions as a sub-game selection switch 72 for shifting to the sub-game session.

The C switch 80 functions as a center stop switch 81 for stopping the moving display in the center partitions 21 in the slot machine game.

The D switch 90 functions as a right stop switch 91 for stopping the moving display in the right partitions 22 in the slot machine game, and functions as a main game selection switch 92 not to shift to the sub-game.

The E switch 100 is a credit use switch 101 for using credit medals remaining deposited in the apparatus. One single switching operation allows a single game medal to be dropped in for game playing.

The F switch 110 is a maximum credit use switch 111 for using credit medals remaining deposited in the apparatus, and a symbol movement stop switch 181 for stopping the movement of the numerals in the symbol screen 170.

When the sub-game selection switch 72 is manipulated, the symbol screen partition 170 is provided in the center of the display screen 11. The illumination partitions 171 are switched on for blinking, one after another sequentially in a clockwise rotation in a roulette fashion to vary the numeral indicated.

When the symbol movement stop switch 181 is manipulated with the illumination partitions 171 blinking, sequentially one after another in a clockwise rotation, the blinking action, thus rotation stops at one of the illumination partitions 171. That illumination partition 171 then continuously lights, indicating its numeral. The continuously blinking illumination partition 171 shows the numeral, "2" as shown in FIG. 23.

According to the numeral stopped and presented, the number of the medals already won as the profit is increased or decreased. Specifically, as shown in FIG. 23, when the illumination partitions 171 stop their movement allowing one of them, corresponding to the numeral 2, to continuously light, the number of the medals previously won is doubled; for example, when four medals were previously won, eight medals are now gained (4 medals×2=8 medals). If the illumination partitions 171 stop their movement allowing one of them, corresponding to the numeral 3, to continuously light, then, 12 medals are now gained (4 medals×3=12 medals). If the illumination partition 171 corresponding to the numeral 1 continuously lights, four medals are gained (4 medals×1=4 medals). In this case, the resulting number of medals is neither increased nor decreased. If the illumination partition 171 corresponding to the numeral 0 continuously lights, the number of the medal previously won is now completed lost (4 medals×0=0 medals). Since the stopping process of the illumination partitions 171 is visibly and clearly recognizable like a roulette game, the sub-game is expected to be a more thrilling game.

The fourth embodiment of the present invention related to the sub-game is now discussed referring to FIGS. 25 and 26. FIG. 25 is the explanatory view showing the sub-game screen. FIG. 28 is the enlarged front view of the operation panel.

The display screen 11 in the sub-game according to the fourth embodiment comprises on its top portion a moving target screen partition 191 where a plurality of target symbols 190 sequentially move and on its bottom portion a laser gun 192 as externally manipulable means movable leftwardly and rightwardly for shooting a bullet at moving target symbols 190.

As detailed later, the fourth embodiment in connection with the sub-game is different from the first through third embodiments in that whether the profit already won by the player is further increased or completely lost is determined by the type of symbol 190 hit by the bullet shot by the laser gun 192.

The operation panel 12 in the fourth embodiment is provided with six switches, A through F switches in that order from the left as shown in FIG. 26. The functions of the A through F switches are as follows:

The A switch 60 functions as the main start lever switch 61 for starting the moving display in each of the screen partitions 20 through 22 in the main game or slot machine game in this embodiment. The A switch 60 also functions as sideway movement switch 200 for starting the movement of the target symbols 190 in the moving target screen partition 191 in the sub-game and also for moving sideways the laser gun 192 to the left or right on the display screen 11 by lever manipulation.

The B switch 70 functions as a left stop switch 71 for stopping the moving display on the left-hand side partitions 20 in the slot machine game, and functions as a sub-game selection switch 72 for shifting to the sub-game session.

The C switch 80 functions as a center stop switch 81 for stopping the moving display in the center partitions 21 in the slot machine game.

The D switch 90 functions as a right stop switch 91 for stopping the moving display in the right partitions 22 in the slot machine game, and functions as a main game selection switch 92 not to shift to the sub-game.

The E switch 100 is a credit use switch 101 for using credit medals remaining deposited in the apparatus. One single switching operation allows a single game medal to be dropped in for game playing.

The F switch 110 is a maximum credit use switch 111 for using credit medals remaining deposited in the apparatus, and a bullet shoot switch 201 as externally manipulable means for allowing the laser gun 192 to shoot a bullet.

The determination of the result of a sub-game playing according to the fourth embodiment is performed as follows:

In the fourth embodiment in connection with the sub-game, the display screen 11 comprises on its top portion the moving target screen partition 191 as shown in FIG. 25. The moving target screen partition 191 presents a plurality of target symbols for example, ○, Δ, *, ⊙ in this embodiment, on a horizontal line. These target symbols move along the horizontal line in the same direction. The display screen 11 also comprises on its bottom portion the laser gun 192 for shooting a bullet. The laser gun 192 can be moved sideways to the left or right on the display screen 11 by manipulating the sideway movement switch 200. A bullet is shot by manipulating the bullet shoot switch 201, and the bullet may or may not hit any of the target symbols 190.

A determination is made of whether the profit once won by the player is increased or canceled, depending on the target symbol 190 hit by the bullet, among the plurality of target symbols 190 moving in the moving target screen partition 191, Δ in this embodiment. Specifically, when the target symbol 190, is hit by the bullet from the laser gun 192, the number of the medals already won by the player is quadrupled. For the target symbol 190, ○ the number of the medals already won by the player is doubled. For the target symbol 190, ⊙ the number of the medals already won by the player remains unchanged. For the target symbol 190, * the number of the medals already won by the player is entirely canceled. Since the increase or decrease of the profit already won by the player is determined by the target symbol 190 hit by the player, a sub-game playing is expected robe thrilling.

The fifth embodiment of the present invention related to the sub-game is now discussed referring to FIG. 27.

In the fourth embodiment, the target symbols 190 are arranged on the single horizontal line and move along the horizontal line in a single direction in the moving target screen partition 191 in the display screen 11.

In the fifth embodiment, however, target symbols 190 are arranged on several rows with each row bearing the same type of symbols in the moving target screen partition 191 in the display screen 11 as shown in FIG. 27. The directions of the moving target symbols are alternated between a row and the next row under first row. Spacing between the symbols of the same type is irregular.

Specifically, the display screen 11 according to the fifth embodiment presents four types of symbols 190, ⊙, *, ○, Δeach type arranged on a different row across the screen. The four types of symbols move in alternate directions from top to bottom rows.

As in the fourth embodiment, the target symbols 190 moving in the moving target screen partition 191 are aimed and shot at by the laser gun 192. Depending on the symbol 190 hit by the laser gun 192, the profit already won by the player is increased or canceled. For example, when the target symbol 190, ⊙ is hit, the number of the medals is quadrupled. When the target symbol 190, * is hit, the number of the medals is tripled. When the target symbol 190, ○ is hit, the number of the medals is doubled. When the target symbol 190, Δ the number of the medals remains unchanged. When no symbols are hit at all, all the medals once won are canceled. The above arrangement makes a sub-game playing even more thrilling than the fourth embodiment.

As described above, the profit, or medals won in the slot machine game is increased or decreased according to the result of a shooting game that is different from the slot machine game. The player thus continues game playing with a more interest.

The sixth embodiment of the present invention related to the sub-game is now discussed referring to FIG. 28.

Steps in FIG. 28 having identical reference numerals with reference to the flow diagram in FIG. 18 remain unchanged from those in the first embodiment, and their detailed explanation is omitted.

The first through fifth embodiments permit only a single type sub-game that is run independent of the slot machine game as the main game.

In the sixth embodiment, the sub-game that is run on the medals won in the slot machine game is selected from among those of the first through fifth embodiments. For example, the operation panel 12 may be separately provided with a sub-game type selection switch. After selecting the shifting to the sub-game, one of the sub-games of first to fifth embodiments may be selected at the player's option by manipulating the sub-game type selection switch.

Specifically, in the sub-game process 130 in FIG. 28, when a determination at step 133 reveals that the start of a sub-game is selected, the process goes to step 119. At step 119, the player manipulates the sub-game type selection switch to select one sub-game from among those in the first through fifth embodiments.

When one of the sub-games of first through fifth embodiments is selected at step 119, the process goes to step 134, initiating the selected sub-game.

As described above, by allowing the player to select any sub-game of interest, he can enjoy the sub-game more. The player also can enjoy different types of sub-games. Since a diversity of sub-games are available, the player may have the option to select one that meets his taste, from among others. The player is free from boredom even when he continues playing for a long time.

The description of the above embodiments of the present invention have been presented for the purpose of illustration and is not intended to limit the invention. The scope of the present invention is defined by appended claims. Various modifications and chances may made without departing from the scope of the invention as set forth in appended claims.

What is claimed is:

1. A picture amusement apparatus comprising:

main game start enable means for making a slot machine game as the main game, ready to start on a display screen on condition that a medal is entered;

main game control means for running the main game conditional on the entry of a start signal in the slot machine game that is set to be ready to start by the main game start enable means;

main game determination means for determining the result of the slot machine game run by the main game control means;

sub-game shift selection means that allows the player to have the option to shift to a sub-game on a display different from the slot machine game, in response to the player's external maneuvering on condition that a profit is given in the main game by the main game determination means;

sub-game control means for running the sub-game on condition that the shifting to the sub-game is selected by the sub-game shift selection means, wherein said sub-game control means comprises increase criteria selection means which allows the player to select between two criteria in response to the player's external maneuvering, one criterion that sets the increase of the profit on condition that a select numeral stopped and presented in select numeral indicator partitions is greater than a basic numeral stopped and presented in a basic numeral screen partition and the other criterion that sets the increase of the profit on condition that the select numeral is smaller than the basic numeral, by comparing the basic numeral stopped and presented in said basic numeral screen with the select numeral stopped and presented in said select numeral indicator partitions; and increase/decrease means for increasing or decreasing the profit provided by the main game determination means, according to the result of the sub-game that is run by the sub-game control means.

2. The picture amusement apparatus according to claim 1, further comprising sub-game continued running selection means for giving the player the option to continue the sub-game in response to the player's external maneuvering on condition that the profit scored by the player has been increased by the profit increase/decrease means.

3. The picture amusement apparatus according to claim 2, wherein:

the basic numeral screen and the select numeral indicator partitions have numerals scrolling within a predetermined range, the apparatus further comprising:

basic numeral scroll stop means for allowing the player to stop the scrolling of the numerals in the basic numeral screen partition in response to the player's external maneuvering; and select numeral scroll stop means for allowing the player to stop the scrolling of the numerals in the select numeral indicator partitions in response to the player's external maneuvering.

4. The picture amusement apparatus according to claim 1, wherein:

the basic numeral screen and the select numeral indicator partitions have numerals scrolling within a predetermined range, the apparatus further comprising:

basic numeral scroll stop means for allowing the player to stop the scrolling of the numerals in the basic numeral screen partition in response to the player's external maneuvering; and select numeral scroll stop means for allowing the player to stop the scrolling of the numerals in the select numeral indicator partitions in response to the player's external maneuvering.

* * * * *

UNITED STATES PATENT AND TRADEMARK OFFICE

CERTIFICATE OF CORRECTION

PATENT NO. : 5,664,999
DATED : September 9, 1997
INVENTOR(S) : Kurihara

It is certified that error appears in the above-indentified patent and that said Letters Patent is hereby corrected as shown below:

| | | |
|---|---|---|
| Col. 1, line 25 | - | delete "WO88/05407" and substitute -- WO86/05407 -- |
| Col. 4, line 47 | - | after " through" insert -- 42.)-- |
| Col. 4, line 59 | - | after "FIG." insert -- 21. -- |
| Col. 5, line 11 | - | after "FIG." insert -- 23. -- |
| Col. 9, line 5 | - | delete "81" and substitute -- 61 -- |
| Col. 10, line 46 | - | delete "2" and substitute -- 5 --; |
| Col. 10, line 48 | - | after "FIG." insert -- 12. -- |
| Col. 10, line 60 | - | delete "138" and substitute -- 136 -- |
| Col. 11, line 19 | - | after "FIG." insert -- 15 -- |
| Col. 13, line 30 | - | after "FIG." insert -- 21. -- |
| Col. 14, line 28 | - | delete "P.8" and substitute -- 23 -- |
| Col. 16, line 58 | - | after "190" insert -- o -- |
| Col. 16, line 67 | - | delete "robe" and substitute -- to be -- |

Signed and Sealed this

Eighth Day of September, 1998

*Attest:*

Bruce Lehman

BRUCE LEHMAN

*Attesting Officer*

*Commissioner of Patents and Trademarks*